US007186318B2

(12) United States Patent
Liu et al.

(10) Patent No.: US 7,186,318 B2
(45) **Date of Patent: *Mar. 6, 2007**

(54) SOFT TISSUE HYDROPHILIC TISSUE PRODUCTS CONTAINING POLYSILOXANE AND HAVING UNIQUE ABSORBENT PROPERTIES

(75) Inventors: Kou-Chang Liu, Appleton, WI (US); Amber Marie Fortune, Appleton, WI (US); Thomas Gerard Shannon, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 398 days.

This patent is subject to a terminal disclaimer.

(21) Appl. No.: 10/741,041

(22) Filed: Dec. 19, 2003

(65) Prior Publication Data

US 2005/0136265 A1 Jun. 23, 2005

(51) Int. Cl.
*D21H 25/02* (2006.01)

(52) U.S. Cl. ..... 162/164.4; 162/157.2

(58) Field of Classification Search ..... 162/164.4, 162/157.2

See application file for complete search history.

(56) References Cited

U.S. PATENT DOCUMENTS

| | | | |
|---|---|---|---|
| 2,757,150 | A | 7/1956 | Heritage |
| 3,224,926 | A | 12/1965 | Bernardin |
| 3,241,553 | A | 3/1966 | Steiger |
| 3,440,135 | A | 4/1969 | Chung |
| 3,556,932 | A | 1/1971 | Cosica et al. |
| 3,556,933 | A | 1/1971 | Williams et al. |
| 3,700,623 | A | 10/1972 | Kelm |
| 3,772,076 | A | 11/1973 | Keim |
| 3,855,158 | A | 12/1974 | Petrovich et al. |
| 3,899,388 | A | 8/1975 | Petrovich et al. |
| 4,128,692 | A | 12/1978 | Reid |
| 4,129,528 | A | 12/1978 | Petrovich et al. |
| 4,147,586 | A | 4/1979 | Petrovich et al. |
| 4,222,921 | A | 9/1980 | Van Eenam |
| 4,297,860 | A | 11/1981 | Pacifici et al. |
| 4,303,471 | A | 12/1981 | Laursen |
| 4,357,827 | A | 11/1982 | McConnell |
| 4,425,186 | A | 1/1984 | May et al. |
| 4,432,833 | A | 2/1984 | Breese |
| 4,440,597 | A | 4/1984 | Wells et al. |
| 4,469,746 | A | 9/1984 | Weisman et al. |
| 4,508,860 | A | 4/1985 | Hawes |
| 4,514,345 | A | 4/1985 | Johnson et al. |
| 4,528,239 | A | 7/1985 | Trokhan |
| 4,529,480 | A | 7/1985 | Trokhan |
| 4,556,450 | A | 12/1985 | Chuang et al. |
| 4,584,357 | A | 4/1986 | Harding |
| 4,600,462 | A | 7/1986 | Watt |
| 4,663,220 | A | 5/1987 | Wisneski et al. |
| 4,773,110 | A | 9/1988 | Hopkins |
| 4,898,642 | A | 2/1990 | Moore et al. |
| 4,950,545 | A | 8/1990 | Walter et al. |
| 5,057,166 | A | 10/1991 | Young, Sr. et al. |
| 5,059,282 | A | 10/1991 | Ampulski et al. |
| 5,068,009 | A | 11/1991 | Jokinen et al. |
| 5,071,675 | A | 12/1991 | Gupta et al. |
| 5,098,522 | A | 3/1992 | Smurkoski et al. |
| 5,223,090 | A | 6/1993 | Klungness et al. |
| 5,226,992 | A | 7/1993 | Morman |
| 5,227,242 | A | 7/1993 | Walter et al. |
| 5,230,776 | A | 7/1993 | Andersson et al. |
| 5,246,545 | A | 9/1993 | Ampulski et al. |
| 5,260,171 | A | 11/1993 | Smurkoski et al. |
| 5,275,700 | A | 1/1994 | Trokhan |
| 5,300,192 | A | 4/1994 | Hansen et al. |
| 5,328,565 | A | 7/1994 | Rasch et al. |
| 5,334,289 | A | 8/1994 | Trokhan et al. |
| 5,338,352 | A * | 8/1994 | Breneman et al. ..... 106/285 |
| 5,348,620 | A | 9/1994 | Hermans et al. |
| 5,353,521 | A | 10/1994 | Orloff |
| 5,431,786 | A | 7/1995 | Rasch et al. |
| 5,443,899 | A | 8/1995 | Barcus et al. |
| 5,489,469 | A | 2/1996 | Kobayashi et al. |
| 5,492,759 | A | 2/1996 | Eriksson et al. |
| 5,496,624 | A | 3/1996 | Stelljes, Jr. et al. |
| 5,500,277 | A | 3/1996 | Trokhan et al. |
| 5,501,768 | A | 3/1996 | Hermans et al. |
| 5,514,523 | A | 5/1996 | Trokhan et al. |
| 5,547,541 | A | 8/1996 | Hansen et al. |
| 5,554,467 | A | 9/1996 | Trokhan et al. |
| 5,558,873 | A | 9/1996 | Funk et al. |
| 5,566,724 | A | 10/1996 | Trokhan et al. |
| 5,598,642 | A | 2/1997 | Orloff et al. |
| 5,598,643 | A | 2/1997 | Chuang et al. |

(Continued)

FOREIGN PATENT DOCUMENTS

| | | |
|---|---|---|
| CA | 2 370 380 A1 | 10/2000 |

(Continued)

OTHER PUBLICATIONS

TAPPI Official Test Method T 402 om-93, "Standard Conditioning and Testing Atmospheres For Paper, Board, Pulp Handsheets, and Related Products," published by the TAPPI Press, Atlanta, Georgia, revised 1993, pp. 1-3.

(Continued)

*Primary Examiner*—Margaret G. Moore
(74) *Attorney, Agent, or Firm*—Judy Garot

(57) ABSTRACT

The present invention is a polysiloxane treated hydrophilic tissue sheet having a polydialkylsiloxane content of about 0.4% or greater by weight of dry pulp fibers. The polysiloxane treated hydrophilic tissue sheet may also have a wet out time after aging 20 days at about 130° F. of about 10 seconds or less.

31 Claims, 1 Drawing Sheet

U.S. PATENT DOCUMENTS 5,624,790 A 4/1997 Trokhan et al.
5,628,876 A 5/1997 Ayers et al.
5,637,194 A 6/1997 Ampulski et al.
5,656,132 A 8/1997 Farrington, Jr. et al.
5,693,411 A 12/1997 Hansen et al.
5,695,868 A 12/1997 McCormack
5,772,845 A 6/1998 Farrington, Jr. et al.
5,785,813 A 7/1998 Smith et al.
5,814,188 A 9/1998 Vinson et al.
5,843,056 A 12/1998 Good et al.
5,928,470 A 7/1999 Shannon
5,935,383 A 8/1999 Sun et al.
5,981,689 A 11/1999 Mitchell et al.
5,986,166 A 11/1999 Mukaida et al.
6,054,020 A * 4/2000 Goulet et al. ..... 162/112
6,072,101 A 6/2000 Beihoffer et al.
6,087,448 A 7/2000 Mitchell et al.
6,096,169 A 8/2000 Hermans et al.
6,103,063 A 8/2000 Oriaran et al.
6,110,533 A 8/2000 Cote et al.
6,117,525 A 9/2000 Trokhan et al.
6,121,409 A 9/2000 Mitchell et al.
6,143,135 A 11/2000 Hada et al.
6,149,934 A 11/2000 Krzysik et al.
6,159,591 A 12/2000 Beihoffer et al.
6,168,852 B1 1/2001 Smith, III et al.
6,194,631 B1 2/2001 Mitchell et al.
6,222,091 B1 4/2001 Beihoffer et al.
6,224,714 B1 5/2001 Schroeder et al.
6,228,506 B1 5/2001 Hosatte et al.
6,231,719 B1 5/2001 Garvey et al.
6,235,155 B1 5/2001 Schroeder et al.
6,235,965 B1 5/2001 Beihoffer et al.
6,261,580 B1 7/2001 Lehrter et al.
6,270,893 B1 8/2001 Young, Sr. et al.
6,274,667 B1 8/2001 Shannon et al.
6,287,418 B1 9/2001 Schroeder et al.
6,300,259 B1 10/2001 Westland et al.
6,342,298 B1 1/2002 Evans et al.
6,365,667 B1 4/2002 Shannon et al.
6,376,072 B1 4/2002 Evans et al.
6,379,498 B1 4/2002 Burns et al.
6,392,116 B1 5/2002 Beihoffer et al.
6,423,183 B1 7/2002 Goulet et al.
6,432,268 B1 8/2002 Burghardt
6,432,270 B1 * 8/2002 Liu et al. ..... 162/164.4
6,458,343 B1 10/2002 Zeman et al.
6,461,553 B1 10/2002 Hansen et al.
6,509,512 B1 1/2003 Beihoffer et al.
6,511,580 B1 1/2003 Liu
6,514,383 B1 2/2003 Liu et al.
6,521,339 B1 2/2003 Hansen et al.
6,552,245 B1 4/2003 Roessler et al.
6,555,502 B1 4/2003 Beihoffer et al.
6,582,560 B2 6/2003 Runge et al.
6,599,393 B1 7/2003 Liu
6,599,394 B1 7/2003 Liu et al.
6,632,904 B2 10/2003 Schroeder et al.
6,896,766 B2 5/2005 Sarbo et al.
6,916,402 B2 7/2005 Shannon et al.
6,936,136 B2 8/2005 Shannon et al.
2001/0001312 A1 5/2001 Mitchell et al.
2001/0007064 A1 7/2001 Mitchell et al.
2001/0029358 A1 10/2001 Beihoffer et al.
2001/0037100 A1 11/2001 Shanklin
2001/0044612 A1 11/2001 Beihoffer et al.
2002/0007166 A1 1/2002 Mitchell et al.
2002/0015846 A1 2/2002 Evans et al.
2002/0162243 A1 11/2002 Runge et al.
2003/0014027 A1 1/2003 Beihoffer et al.
2003/0124171 A1 7/2003 Sun et al.
2003/0131962 A1 7/2003 Lindsay et al.
2003/0208173 A1 11/2003 Lagerstedt-Eidrup et al.
2004/0023579 A1 2/2004 Kainth et al.
2004/0045687 A1 3/2004 Shannon et al.
2004/0074622 A1 4/2004 Liu et al.
2004/0084164 A1 5/2004 Shannon et al.
2004/0084165 A1 5/2004 Shannon et al.
2004/0086726 A1 5/2004 Moline et al.
2004/0100376 A1 5/2004 Lye et al.
2004/0118531 A1 6/2004 Shannon et al.
2004/0144507 A1 7/2004 Shannon et al.
2004/0163785 A1 8/2004 Shannon et al.
2004/0234804 A1 11/2004 Liu et al.
2004/0253890 A1 12/2004 Ostgard et al.
2005/0136759 A1 6/2005 Shannon et al.
2005/0137547 A1 6/2005 Garnier et al.

FOREIGN PATENT DOCUMENTS

EP 0 192 216 B1 6/1990
EP 0 217 032 B1 2/1992
WO WO 98/19013 A1 5/1998
WO WO 99/25393 A2 5/1999
WO WO 99/25745 A1 5/1999
WO WO 99/25748 A1 5/1999
WO WO 00/56959 A1 9/2000
WO WO 00/63295 A1 10/2000
WO WO 01/49937 A1 7/2001
WO WO 02/10032 A2 2/2002
WO WO 02/34184 A1 5/2002
WO WO 02/072951 A2 9/2002
WO WO 2002/077048 A2 10/2002
WO WO 2002/081819 A1 10/2002
WO WO 03/018671 A1 3/2003
WO WO 03/037392 A1 5/2003
WO WO 2004/044327 A1 5/2004
WO WO 2004/050995 A1 6/2004
WO WO 2004/101684 A1 11/2004

OTHER PUBLICATIONS

TAPPI Official Test Method T 410 om-98, "Grammage of Paper and Paperboard (Weight Per Unit Area)," published by the TAPPI Press, Atlanta, Georgia, revised 1998, pp. 1-5.
TAPPI Official Test Method T 411 om-89, "Thickness (Caliper) of Paper, Paperboard, and Combined Board," published by the TAPPI Press, Atlanta, Georgia, revised 1989, pp. 1-3.
TAPPI Official Test Method T 530 pm-89, "Size Test for Paper By Ink Resistance (Hercules Method)," published by the TAPPI Press, Atlanta, Georgia, revised 1989, pp. 1-5.
Foulger, M. et al., "New Technology to Apply Starch and Other Additives," *Pulp & Paper Canada*, vol. 100, No. 2, 1999, pp. 24-25.

* cited by examiner

SOFT TISSUE HYDROPHILIC TISSUE PRODUCTS CONTAINING POLYSILOXANE AND HAVING UNIQUE ABSORBENT PROPERTIES

BACKGROUND OF THE INVENTION

In the manufacture of tissue products, such as facial tissue, bath tissue, paper towels, dinner napkins and the like, a wide variety of product properties are imparted to the final product through the use of chemical additives. One common attribute imparted to tissue sheets through the use of chemical additives is softness. There are two types of softness that are typically imparted to tissue sheets through the use of chemical additives. The two types are bulk softness and topical or surface softness.

Bulk softness may be achieved by a chemical debonding agent. Such debonding agents are typically quaternary ammonium entities containing long chain alkyl groups. The cationic quaternary ammonium entity allows for the agent to be retained on the cellulose via ionic bonding to anionic groups on the cellulose fibers. The long chain alkyl groups provide softness to the tissue sheet by disrupting fiber-to-fiber hydrogen bonds within the tissue sheet.

Such disruption of fiber-to-fiber bonds provides a two-fold purpose in increasing the softness of the tissue sheet. First, the reduction in hydrogen bonding produces a reduction in tensile strength thereby reducing the stiffness of the tissue sheet. Secondly, the debonded fibers provide a surface nap to the tissue sheet enhancing the "fuzziness" of the tissue sheet. This tissue sheet fuzziness may also be created through use of creping as well, where sufficient interfiber bonds are broken at the outer tissue surface to provide a plethora of free fiber ends on the tissue surface.

A multi-layered tissue structure may be utilized to enhance the softness of the tissue sheet. In this embodiment, a thin layer of strong softwood fibers is used in the center layer to provide the necessary tensile strength for the tissue product. The outer layers of such structures may be composed of the shorter hardwood fibers, which may or may not contain a chemical debonder.

The topical or surface softness of a tissue sheet, and ultimately the resulting tissue product, may be achieved by topically applying an emollient to the surface of the tissue sheet or tissue product. The term emollient as used herein refers to a treatment capable of making a tissue sheet less harsh or abrasive. One such emollient is polysiloxane. Polysiloxane treated tissues are described in U.S. Pat. No. 4,950,545, issued on Aug. 21, 1990 to Walter et al.; U.S. Pat. No. 5,227,242, issued on Jul. 13, 1993 to Walter et al.; U.S. Pat. No. 5,558,873, issued on Sep. 24, 1996 to Funk et al.; U.S. Pat. No. 6,054,020, issued on Apr. 25, 2000 to Goulet et al.; U.S. Pat. No. 6,231,719, issued on May 15, 2001 to Garvey et al.; and, U.S. Pat. No. 6,432,270, issued on Aug. 13, 2002 to Liu et al., which are incorporated by reference to the extent that they are non-contradictory herewith. A variety of substituted and non-substituted polysiloxanes may be used.

While polysiloxanes may provide improved softness in a tissue sheet and/or tissue products, there may be some drawbacks to their use. Polysiloxanes are also generally hydrophobic, that is, they tend to repel water. For many tissue applications, particularly sanitary bath tissue, this significantly reduces the utility of polysiloxanes to create softness in the tissue product. Tissue sheets and/or tissue products treated with polysiloxane tend to be less absorbent than tissue products not containing polysiloxane. An additional disadvantage to the use of polysiloxanes in tissue sheets and/or tissue products, particularly hydrophobic amino functional polysiloxanes is the effect of aging on hydrophobicity. Elevated temperatures and time can significantly increase the hydrophobicity of treated tissue sheets and/or tissue products and in cases such as bath tissue may render the tissue product unacceptable for a given application after a certain period of time or under certain environmental conditions.

It is known to add a wetting agent directly to a polysiloxane emulsion then topically apply the polysiloxane, wetting agent composition to the tissue sheet to mitigate the hydrophobicity caused by addition of the polysiloxane. While this perhaps reduces the overall hydrophobicity of the sheet, there are several issues associated with using the wetting agents. First, wetting agents are hydrophilic and are usually incompatible with the neat polysiloxane. As such, if the wetting agent and polysiloxane are applied in the same step, they must be applied as an emulsion. Addition as a neat polysiloxane fluid is precluded.

During the production of tissue sheets and tissue products, significant amounts of scrap material are accumulated. This waste product, also known as broke, is generated from products that do not fall within manufacturer's specifications or from excess paper remaining after the finished product is completed. Since broke is comprised essentially of 100% fibers, ability to recycle it in tissue products eliminates the inefficient disposal of a valuable source of papermaking fibers. This broke is typically repulped and added directly to the virgin fibers in the tissue making process. As the wetting agents are water soluble or water dispersible they are prone to loss during the broke repulping and tissue making processes and, hence, the finished tissue sheet containing the polysiloxane treated tissue broke may contain a level of unwanted hydrophobicity.

Polysiloxane wetting agents are also known. The polysiloxane wetting agents are highly substituted low molecular weight polysiloxanes that are water soluble. As they are of low molecular weight and high degree of substitution they do not contribute to the softness of the tissue sheet. As with other wetting agents, they are not retained by the fibers and will be lost in the broke repulping and tissue making processes. Another disadvantage to the use of wetting agents is the buildup of the unretained wetting agents in the tissue process water. As the wetting agents function by reducing surface tension their buildup will reduce the surface tension of the process water. This reduction in surface tension of the process water causes unwanted reduction of the dry strength of the tissue web.

High molecular weight hydrophilic polysiloxanes are known in the art, however, such hydrophilic polysiloxanes are typically more water soluble and hence when applied to a tissue sheet will tend to migrate more in the z-direction of the tissue sheet than the hydrophobic polysiloxanes. The hydrophilic polysiloxanes are highly modified, replacing n-alkyl groups on the polysiloxane backbone with polyether or similar hydrophilic groups. Hydrophilic polysiloxanes typically are also usually sold at a cost premium to the hydrophobic polysiloxanes. The hydrophobic portion of the polysiloxane, referred to as the polydialkylpolysiloxane portion, also tends to have a more significant impact on improving softness. Hence, the highly modified hydrophilic polysiloxanes also tend to be less effective at softening and more costly to use than hydrophobic polysiloxanes.

Hydrophobic polysiloxanes may be blended with the high molecular weight hydrophilic polysiloxanes and such a blend topically to a tissue sheet and/or a tissue product to help mitigate the hydrophobicity issues associated with use of hydrophobic polysiloxanes. While such a blend helps to control and mitigate issues associated with hydrophobicity of the hydrophobic polysiloxanes, the hydrophilic polysiloxanes tend to migrate significantly more in the z-direction of the pretreated tissue sheet than the more hydrophobic polysiloxanes. Over time the hydrophilic polysiloxanes may migrate away from the hydrophobic polysiloxanes and with aging the hydrophobicity of the pretreated tissue sheet and/or tissue product may increase significantly to the point where the pretreated tissue product may no longer be suited for its intended application.

Additionally, the hydrophilic polysiloxanes generally described in the art have no functional group to anchor themselves to pulp fibers. As a result, these polysiloxanes may be readily lost to process water in the event that the polysiloxane treated tissue sheet and/or tissue product is used as a source of broke for additional tissue making processes. A couple of issues may result from the loss of the hydrophilic polysiloxane in the broke repulping operation. First, the polysiloxane contamination of the process water may cause significant issues in various process equipment and operations. Second, as the hydrophobic polysiloxanes may be retained in the wet end of the tissue making process due to the presence of functional groups, such as primary or secondary amines, tissue sheets and/or tissue products made from the broke fibers may exhibit unacceptable hydrophobicity if too much broke is used.

Therefore, there is a need for polysiloxane treated tissue sheets and/or tissue products having high levels of polydialkylpolysiloxane that have improved hydrophilic properties while still providing for softness enhancement in the polysiloxane pretreated tissue sheets and/or tissue products where they are incorporated. There is a further need to have the pulp fibers retain their hydrophilicity when recycled or used in broke and to have the pulp fibers and tissue sheets and/or tissue products containing the pulp fibers exhibit good thermal and aging stability with regard to hydrophobicity.

There is an interest in creating polysiloxane pretreated tissue sheets and/or tissue products that have softness equivalent to softness created by hydrophobic polydialkylsiloxanes, yet have excellent hydrophilic properties even upon thermal aging. There is a further interest in creating such polysiloxane pretreated tissue sheets and/or tissue products in a cost effective manner. Additionally, there is an interest in creating hydrophilic polysiloxane pretreated tissue sheets and/or tissue products exhibiting good retention of the polydialkylsiloxane through the tissue making process while maintaining good hydrophilic properties to enable expanded use of the polysiloxane pretreated tissue sheets and/or tissue products as a source for recycle and broke.

It has now been discovered that the present invention of blending certain amino functional polyether polysiloxanes with hydrophobic polysiloxanes and, in particular, amino-functional polydialkylsiloxanes for treatment of pulp fibers for use in tissue sheets and/or tissue products provide such treated tissue sheets and/or tissue products having improved softness, hydrophilicity and aging stability while having high levels of polydialkylsiloxane. Both the polyether polysiloxane and the hydrophobic polysiloxane are retained very well through the wet end of the tissue making process yet the hydrophilic properties of the tissue sheets and/or tissue products made with recycled pulp fibers that contained the polysiloxane composition demonstrate excellent hydrophilic properties.

SUMMARY OF THE INVENTION

While the products of the present invention may be useful in a variety of products, particular interest may be in tissue and towel products. It is understood that the term "tissue sheet" as used herein refers to tissue and towel sheets. The term "tissue product" as used herein refers to tissue and towel products. Tissue and towel products as used herein are differentiated from other paper products in terms of their bulk. The bulk of the tissue and towel products of the present invention is calculated as the quotient of the caliper (hereinafter defined), expressed in microns, divided by the basis weight, expressed in grams per square meter. The resulting bulk is expressed as cubic centimeters per gram. Writing papers, newsprint and other such papers have higher strength, stiffness and density (low bulk) in comparison to tissue and towel products which tend to have much higher calipers for a given basis weight. The tissue and towel products of the present invention may have a bulk of about 2 $cm^3/g$ or greater, more specifically about 2.5 $cm^3/g$ or greater, and still more specifically about 3 $cm^3/g$ or greater.

The term "layered tissue sheet" as used herein refers to the formation of a stratified tissue sheet, wherein a particular tissue sheet or tissue sheets making up a multi-ply tissue product contain a z-directional fiber gradient. In one method of the formation of a layered tissue sheet, individual slurries of pulp fibers are sent to a divided headbox and applied to a moving belt where the pulp fibers are dewatered by any of a variety of processes and further dried to form a tissue sheet that has a specific distribution of pulp fibers in the z-direction based on the split of the individual furnishes. Two or more layers may be present in a given tissue sheet of a multi-ply tissue product. The term "blended tissue sheet" as used herein refers to the formation of a single layered or layered tissue sheet where there is a homogeneous distribution of pulp fibers in the z-direction of the sheet.

The term "substantively affixing" as used herein refers to the ability of a group on the polysiloxane molecule to bind the polysiloxane molecule to the substrate pulp fibers in such a manner that the polysiloxane molecule is highly retained on the substrate through any subsequent processing steps or broke recycling process steps.

One embodiment of the present invention is a polysiloxane treated hydrophilic tissue sheet or tissue product containing a high level of a polydialkylsiloxane. Another embodiment of the present invention is a polysiloxane treated hydrophilic tissue sheet comprising: 1) a hydrophobic polysiloxane containing a group capable of substantively affixing the polysiloxane to pulp fibers; 2) a hydrophilic polysiloxane containing a functional group capable of substantively affixing the polysiloxane to the pup fibers; and, optionally, 3) an additional polysiloxane or polysiloxanes. Another embodiment of the present invention is a polysiloxane treated hydrophilic tissue sheet having a high level of polydialkylsiloxane, yet having an ability to retain both the polysiloxane and hydrophilicity when the treated pulp fibers of the tissue product are used as broke for other tissue products.

The particular structure of the polysiloxanes of the present invention may provide the desired product properties to the tissue sheet and/or tissue product. Polysiloxanes encompass a very broad class of compounds. They are characterized in having a backbone structure:

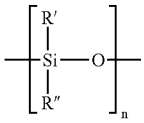

where R' and R" may be a broad range of organo and non-organo groups including mixtures of such groups and where n is an integer ≧2. These polysiloxanes may be linear, branched, or cyclic. They may include a wide variety of polysiloxane copolymers containing various compositions of functional groups, hence, R' and R" actually may represent many different types of groups within the same polymer molecule. The organo or non-organo groups may be capable of reacting with pulp fibers to covalently, ionically or hydrogen bond the polysiloxane to the pulp fibers. These functional groups may also be capable of reacting with themselves to form crosslinked matrixes with the pulp fibers. The scope of the present invention should not be construed as limited by a particular polysiloxane structure so long as that polysiloxane structure delivers the aforementioned product benefits to the tissue sheet and/or the final tissue product.

While not wishing to be bound by theory, the softness benefits that polysiloxanes deliver to tissue sheets and/or tissue products treated with the polysiloxanes of the present invention may be, in part, related to the molecular weight of the polysiloxane. Viscosity is often used as an indication of molecular weight of the polysiloxane as exact number average or weight average molecular weights may be difficult to determine. The viscosity of the polysiloxanes of the present invention may be about 25 centipoise or greater, more specifically about 100 centipoise or greater, and most specifically about 200 centipoise or greater. The term "viscosity" as referred to herein refers to the viscosity of the neat polysiloxane itself and not to the viscosity of an emulsion if so delivered. It should also be understood that the polysiloxanes of the present invention may be delivered as solutions containing diluents. Such diluents may lower the viscosity of the polysiloxane solution below the limitations set above, however, the efficacious part of the polysiloxane should conform to the viscosity ranges given above. Examples of such diluents include but is not limited to oligomeric and cyclo-oligomeric polysiloxanes such as octamethylcyclotetrasiloxane, octamethyltrisiloxane, decamethylcyclopentasiloxane, decamethyltetrasiloxane and the like, including mixtures of these diluents.

The particular form in which the polysiloxanes of the present invention are delivered to the tissue web in the manufacture of the polysiloxane tissue sheet or tissue product may be any form known in the art. Polysiloxanes useful for the present invention may be delivered as neat fluids; aqueous or non-aqueous solutions; aqueous or non-aqueous dispersions; and, emulsions, including microemulsions, stabilized by suitable surfactant systems that may confer a charge to the emulsion micelles. Nonionic, cationic, and anionic systems may be employed.

Polysiloxane surfactants and wetting agents are known in the art. It is known that these surfactants may be used in conjunction with polysiloxanes to reduce the hydrophobicity of articles treated with hydrophobic polysiloxanes. These polysiloxane surfactants and wetting agents are low molecular weight, low viscosity materials having very high levels of ethylene oxide side chains and very few, if any, polydialkylsiloxane units. The low viscosity, high level of substitution and low level of polydialkylsiloxane units prevents these polysiloxane surfactants from providing a noticeable softness benefit to tissue sheets and/or tissue products treated with these polysiloxanes. Furthermore, they do not have groups capable of anchoring themselves to pulp fibers and hence are not retained in the wet end of the tissue making process. Loss of the surfactant polysiloxane can now cause the pulp fibers from the polysiloxane treated tissue sheets and/or tissue products to create process and product issues including formation of hydrophobic tissue sheets and/or tissue products. While not wishing to be bound by theory it is believed that the hydrophilic polysiloxanes of the present invention provide both wetting and softness improvement due to their high molecular weight, presence of polydialkylsiloxane units on the polysiloxane molecule and presence of amino groups or other functional groups on the silicone molecule that are capable of substantively affixing the hydrophilic polysiloxane on the pulp fibers of the tissue sheet and/or tissue product. Furthermore it is found that the hydrophobic and hydrophilic aminofunctional polysiloxanes are compatible such that they can be mixed as neat fluids without impacting ability to apply the blend to the tissue sheet and/or tissue product.

The level or amount of polysiloxane retained during the broke repulping and tissue making processes may be measured by the silicone retention factor. The silicone retention factor is determined by measuring the level of polysiloxane in the polysiloxane pretreated pulp fibers ($Si^f$), forming a tissue sheet (typically a tissue handsheet) incorporating the polysiloxane pulp fibers and measuring the amount of the polysiloxane present in the tissue sheet (tissue handsheet) ($Si^h$). The silicone retention factor is then calculated using the following equation:

$$\text{Silicone Retention Factor}=(Si^h)/(Si^f)$$

The silicone retention factor may range from about 0.6 or greater, about 0.7 or greater, or about 0.8 or greater. While not wishing to be bound by theory, it is believed that the retention of the polysiloxanes is largely due to the presence of groups such as amino functional groups which are capable of substantively affixing the hydrophilic polysiloxanes to the pulp fibers. These functional groups are capable of bonding with the pulp fibers in a manner that enables the polysiloxanes to be retained through bulk repulping and the wet end of the tissue making process. Furthermore, while not wishing to be bound by theory, it is believed that the compatibility of the hydrophobic and hydrophilic polysiloxanes in conjunction with immobility of the hydrophilic polysiloxane causes improved hydrophobic stability of the polysiloxane treated tissue sheet and/or tissue product.

THE DETAILED DESCRIPTION OF THE INVENTION

Figure 1:
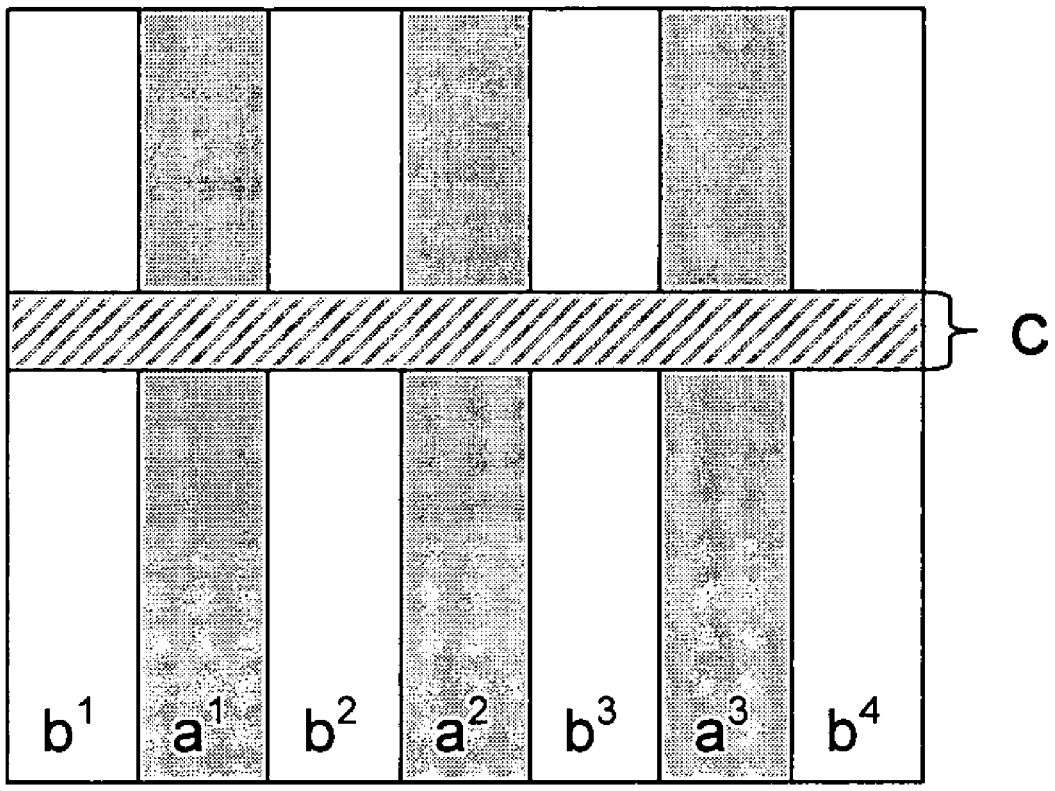
FIG. 1 represents a plan view of a tissue product comprising the present invention.

The particular structure of the polysiloxanes of the present invention may provide the desired product properties to the pulp fibers and tissue sheets and tissue products. Polysiloxanes encompass a very broad class of compounds. They are characterized in having a backbone structure:

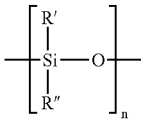

where R' and R" may be a broad range of organo and non-organo groups including mixtures of such groups and where n is an integer ≧2. These polysiloxanes may be linear, branched, or cyclic. They may include a wide variety of polysiloxane copolymers containing various compositions of functional groups, hence, R' and R" actually may represent many different types of groups within the same polymer molecule. The organo or non-organo groups may be capable of reacting with pulp fibers to covalently, ionically or hydrogen bond the polysiloxane to the pulp fibers. These functional groups may also be capable of reacting with themselves to form crosslinked matrixes with the pulp fibers. The scope of the present invention should not be construed as limited by particular polysiloxane structures so long as that polysiloxane structure delivers the aforementioned product benefits to the tissue sheet and/or the final tissue product.

The term "polydialkylsiloxane" as used herein refers to the portion of the polysiloxane molecule as defined above wherein R' and R" are $C_1$–$C_{30}$ aliphatic hydrocarbon groups. In one embodiment of the present invention, R' and R" may be methyl groups forming so called polydimethylsiloxane units. While not wishing to be bound by theory, the polydialkylsiloxane units are believed to be most effective at increasing the softness of tissue sheets and/or tissue products comprising polysiloxane. Functionalized polysiloxanes containing polydialkylsiloxane units may be used for the purposes of the present invention. A variety of functional groups may be present on the polysiloxane polymer in addition to the dialkylsiloxane units. A combination of polysiloxanes may also be used to create the desired tissue sheets and/or tissue products.

The polysiloxane may be delivered to the tissue sheets and/or tissue products in a variety of forms including but not limited to an aqueous emulsion or dispersion, a solution in an organic fluid or non-organic fluid medium, or as a neat polysiloxane containing no added solvents, emulsifiers, or other agents.

A specific class of hydrophobic polysiloxanes suitable for use in the present invention to be blended with the hydrophilic polysiloxane may have the general formula:

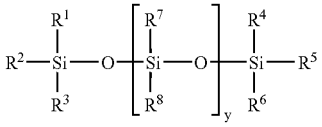

wherein the $R^1$–$R^8$ moieties may be independently any organofunctional group including $C_1$ or higher alkyl groups, aryl groups, ethers, polyethers, polyesters, or other functional groups including the alkyl and alkenyl analogues of such groups and y is an integer >1. Specifically, the $R^1$–$R^8$ moieties may be independently any $C_1$ or higher alkyl group including mixtures of the alkyl groups. Examples of polysiloxanes that may be useful in the present invention are those in the DC-200 fluid series and HMW-2200, manufactured and sold by Dow Corning, Inc., located in Midland, Mich.

Additional examples of hydrophobic polysiloxanes are known in the art and may be well suited for use in the present invention are the so called amino-functional polysiloxanes. These amino functional polysiloxanes having the following general structure may be useful in the present invention:

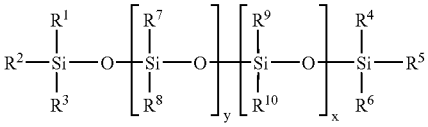

wherein, x and y are integers >0. The mole ratio of x to (x+y) may be from about 0.001 to about 0.25. The $R^1$–$R^9$ moieties may be independently any organofunctional group including $C_1$ or higher alkyl groups, aryl groups, ethers, polyethers, polyesters, amines, imines, amides, or other functional groups including the alkyl and alkenyl analogues of such groups. The $R^{10}$ moiety may be an amino functional moiety including but not limited to primary amine, secondary amine, tertiary amines, quaternary amines, unsubstituted amides and mixtures thereof. In one embodiment, the $R^{10}$ moiety may comprise at least one amine group per constituent or two or more amine groups per substituent, separated by a linear or branched alkyl chain of $C_1$ or greater. Examples of some polysiloxanes that may be useful in the present invention include, but are not limited to, DC 2-8220, DC-8175 and DC-8182 commercially available from Dow Corning, Inc., located in Midland, Mich., Y-14344 commercially available from Crompton, Corp., located at Greenwich, Conn. and AF-2340 commercially available from Wacker, Inc., Adrian, Mich.

The polysiloxane treated tissue sheets and tissue products of the present invention incorporate at least one hydrophilic polysiloxane. Such polysiloxanes may be incorporated in part with other functional polysiloxanes to generate the required hydrophilic properties of the pulp fibers and tissue sheets and products. One common class of hydrophilic polysiloxane is the so called polyether polysiloxanes. Such polysiloxanes generally have the following structure:

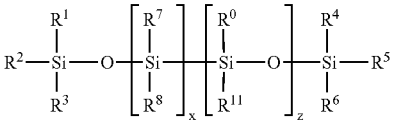

wherein, z is an integer >0 and x is an integer ≧0. The ratio of x to z may be from about 0 to about 1000. The mole ratio of x to (x+z) may be from about 0 to about 0.95. The $R^0$–$R^9$ moieties may be independently any organofunctional group including a $C_1$ or higher alkyl or aryl group or mixtures of such groups. $R^{11}$ may be a polyether functional group having the generic formula: $—R^{12}—(R^{13}—O)_a—(R^{14}O)_b—R^{15}$, wherein $R^{12}$, $R^{13}$, and $R^{14}$ may be independently $C_{1-4}$alkyl groups, linear or branched; $R^{15}$ may be H or a $C_{1-30}$alkyl group; and, "a" and "b" are integers of from about 0 to about 100 wherein a+b>0, more specifically from about 5 to about 30. An example of a commercially available polyether polysiloxane is DC-1248 available from Dow Corning. While these polysiloxanes are broadly taught in the art and used in combination with hydrophobic polysiloxanes their use is limited by the restrictions noted previously. The hydrophilic polysiloxanes of this particular structure lack a functional group capable of anchoring the polysiloxane substantively to the pulp fibers. Hence, the polyether polysiloxanes are removed from the polysiloxane treated tissue sheets and/or tissue products when used in broke repulping and wet laid applications such as tissue or papermaking.

A class of functionalized hydrophilic polysiloxanes particularly suitable for use in the present invention are polyether polysiloxanes that include an additional functional group capable of substantively affixing the hydrophilic polysiloxane to the pulp fibers. Thus, the hydrophilic polysiloxane is retained by the polysiloxane pretreated pulp fibers during wet laid papermaking processes. Such polysiloxanes may generally have the following structure:

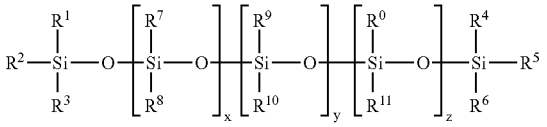

wherein, z is an integers >0, x and y are integers ≧0. The mole ratio of x to (x+y+z) may be from about 0 to about 0.95. The ratio of y to (x+y+z) may be from about 0 to about 0.40. The $R^0$–$R^9$ moieties may be independently any organofunctional group including $C_1$ or higher alkyl groups, aryl groups, ethers, polyethers, polyesters or other functional groups including the alkyl and alkenyl analogues of such groups. The $R^{10}$ moiety is a moiety capable of substantively affixing the polysiloxane to the cellulose. In a specific embodiment the $R^{10}$ moiety is an amino functional moiety including, but not limited to, primary amine, secondary amine, tertiary amines, quaternary amines, unsubstituted amides, and mixtures thereof. An exemplary $R^{10}$ amino functional moiety may contain one amine group per constituent or two or more amine groups per substituent, separated by a linear or branched alkyl chain of $C^1$ or greater. $R^{11}$ may be a polyether functional group having the generic formula: $—R^{12}—(R^{13}—O)_a—(R^{14}O)_b—R^{15}$, wherein $R^{12}$, $R^{13}$, and $R^{14}$ may be independently $C_{1-4}$ alkyl groups, linear or branched; $R^{15}$ may be H or a $C_{1-30}$alkyl group; and, "a" and "b" are integers of from about 1 to about 100, more specifically from about 5 to about 30. Examples of amino-functional polysiloxanes that may be useful in the present invention include the polysiloxanes provided under the trade designation of Wetsoft CTW family manufactured and sold by Wacker, Inc., located Adrian, Mich. Other examples of such polysiloxanes may be found in U.S. Pat. No. 6,432,270, issued on Aug. 13, 2002 to Liu, et al.; U.S. Pat. No. 6,599,393 issued on Jun. 29, 2003 to Liu, et al.; U.S. Pat. No. 6,511,580 issued on Jan. 28, 2003 to Liu, U.S. Pat. No. 6,514,383 issued on Feb. 4, 2003 to Liu, U.S. Pat. No. 6,235,155 issued on May 22, 2001 to Schroeder, et al.; and, U.S. Pat. No. 6,632,904 issued on Oct. 14, 2003 to Schroeder, et al., the disclosure of which is incorporated herein by reference to the extent that it is non-contradictory herewith. In another aspect of the present invention, the moiety capable of affixing the polysiloxane substantively to the pulp fiber may be incorporated into the hydrophilic segment of the polysiloxane polymer or on one of the other $R^0$–$R^{11}$ moieties. In such case, the value of y in the above structure for the hydrophilic polysiloxane may be 0.

The total amount of polysiloxane in the polysiloxane treated tissue products may vary depending upon other things the number of treated and untreated tissue sheets (plies) present in the tissue product. However, the amount of total polysiloxane present in the treated tissue sheets of the present invention may range from about 0.1% to about 10% by weight of dry pulp fibers, more specifically from about 0.4% to about 6% by weight of dry pulp fibers and still more specifically from about 0.6% to about 3% by weight of dry pulp fibers. The amount of polydialkylsiloxane present in the treated tissue sheets or tissue products may range from about 0.1% by weight of dry pulp fibers to about 8% by weight of dry pulp fiber, more specifically from about 0.2% by weight of dry pulp fiber to about 3% by weight dry pulp fiber and still more specifically from about 0.5% by weight of dry pulp fiber to about 2% by weight of dry pulp fiber.

The polysiloxane treated tissue sheets and/or tissue products of the present invention have good absorbency properties despite the high level of polydialkylsiloxane. The absorbency of the polysiloxane treated tissue sheets and/or tissue products may be determined by the Wet Out Time. As used herein, the term "Wet Out Time" is related to absorbency and is the time it takes for a given sample of a tissue sheet and/or tissue product to completely wet out when placed in water. The Wet Out Time (hereinafter defined) for tissue sheets and/or tissue products of the present invention may be about 30 seconds or less, more specifically about 20 seconds or less, still more specifically about 15 seconds or less, still more specifically about 10 seconds or less, still more specifically about 8 seconds or less, still more specifically about 6 seconds or less, and still more specifically about 5 seconds or less.

In one aspect of the present invention, a high level of polysiloxane may be retained on the pulp fibers of the polysiloxane treated tissue sheet and/or tissue product through broke repulping and the subsequent tissue making process despite the polysiloxane having a high level of hydrophilicity. The amount of the polysiloxane retained during broke repulping and subsequent processing of that broke to make a wet laid product may be measured by the silicone retention factor. The silicone retention factor is determined by measuring the level of polysiloxane in the first polysiloxane treated tissue sheet and/or tissue product ($Si^f$), repulping the polysiloxane treated sheet or product, forming a second tissue sheet (typically a tissue handsheet) incorporating the repulped fibers and measuring the amount of the polysiloxane present in the second tissue sheet (tissue handsheet) ($Si^h$). The silicone retention factor is then calculated using the following equation:

$$\text{Silicone Retention Factor}=(Si^h)/(Si^f)$$

The silicone retention factor may range from about 0.6 or greater, about 0.7 or greater, or about 0.8 or greater. While not wishing to be bound by theory, the retention of the polysiloxanes in the present invention may be due at least in part to the presence of amino functional groups on the hydrophilic polysiloxanes. These amino groups may be capable of bonding with pulp fibers in a manner that enables the polysiloxanes to be retained through the wet end of the process.

The tissue sheets (handsheets) made from the repulped polysiloxane treated tissue product are found to have excellent hydrophilic properties. The hydrophilicity of the polysiloxane second treated tissue sheet may be measured using the water drop test described herein after. The water drop test measures the amount of time it takes a handsheet prepared from the repulped polysiloxane treated tissue pulp fibers to absorb a given amount of water. The initial water drop values can range from about 0 seconds to about 30 seconds, more specifically from about 0 seconds to 15 seconds and still more specifically from about 0 seconds to about 10 seconds. The tissue sheet, formed from the repulped polysiloxane treated product, retains hydrophilic properties upon thermal aging as measured by the aged water drop test. In one embodiment of the present invention, the polysiloxane pretreated pulp fibers have a water drop test time after aging at 85° C. for one hour of about 150 seconds or less. In another embodiment of the present invention, the polysiloxane pretreated pulp fibers have a water drop test time after aging at 85° C. for one hour of about 90 seconds or less. In another embodiment of the present invention, the polysiloxane pretreated pulp fibers have a water drop test time after aging at 85° C. for one hour of about 30 seconds or less. In still another embodiment of the present invention, the polysiloxane pretreated pulp fibers have a water drop test time after aging at 85° C. for one hour of about 10 seconds or less.

The ratio of substantive hydrophilic polysiloxane to hydrophobic polysiloxane of the present invention meets specific product properties. In one embodiment of the present invention, the ratio of the substantive hydrophilic polysiloxane to hydrophobic polysiloxane used as a treatment may range from about 9.5:0.5 to about 0.5:9.5, in another embodiment of the present invention from about 8:2 to about 2:8 and in still another embodiment of the present invention from about 2:1 to about 1:2.

While not wishing to be bound by theory, the softness benefits that polysiloxanes deliver to pulp fiber containing products is believed to be, in part, related to the molecular weight of the polysiloxane. Viscosity is often used as an indication of molecular weight of the polysiloxane as exact number or weight average molecular weights are often difficult to determine. The viscosity of the polysiloxanes of the present invention at 25° C. is about 25 centipoise or greater, more specifically about 100 centipoise or greater, and most specifically about 200 centipoise or greater. The term "viscosity" as referred to herein refers to the viscosity of the neat polysiloxane itself and not to the viscosity of an emulsion if so delivered. It should also be understood that the polysiloxanes of the present invention may be delivered as solutions containing diluents. Such diluents may lower the viscosity of the solution below the limitations set above, however, the efficacious part of the polysiloxane should conform to the viscosity ranges given above. Examples of such diluents may include, but is not limited to: oligomeric and cyclo-oligomeric polysiloxanes such as octamethylcyclotetrasiloxane, octamethyltrisiloxane, decamethylcyclopentasiloxane, decamethyltetrasiloxane and the like, including mixtures of these compounds.

The level of total polysiloxane in the polysiloxane treated tissue sheets and/or tissue products may be determined by any method known in the art. If the particular polysiloxane applied to the polysiloxane pretreated pulp fibers is known, the total amount of polysiloxane may be measured by converting the dialkylpolysiloxane component of the polysiloxane to the corresponding dialkyldiflouro silane using $BF_3$ followed by GC quantification of the dialkylpolysiloxane as described herein. The amount of polydialkylsiloxane in a tissue sheet and/or tissue product is determined using the $BF_3$-GC method as described herein.

When the specific polysiloxane applied to the polysiloxane treated tissue sheet and/or tissue product is not known, X-ray Fluorescence Spectroscopy (XRF) may also be used. An example of a suitable instrument is the Lab-X3500 X-ray Fluorescence Analyzer (XRF) available from Oxford Instruments Analytical, LTD, Elk Grove Village, Ill. In determining silicone retention factors, when using XRF spectroscopy, it is not necessary to know the exact concentration of polysiloxane in the sample. X-ray counts between the treated tissue sheets and/or tissue products and the handsheets are compared and retention factor determined from the ratio of counts in the handsheet to counts in the polysiloxane treated tissue sheet and/or tissue product.

The polysiloxane composition may be applied to the tissue sheet and/or tissue product according to various methods discussed below for the present invention. The topical application of the polysiloxane composition to the tissue sheet can be done via any method known in the art including but not limited to:

- Contact printing methods such as gravure, offset gravure or flexographic.
- A spray applied to the formed tissue sheet and/or tissue product. For example, spray nozzles may be mounted over a moving wet tissue sheet and/or tissue product to apply a desired dose of polysiloxane composition to the wet tissue sheet. Nebulizers may also be used to apply a light mist to a surface of a wet tissue sheet.
- Non-contact printing methods such as ink jet printing, digital printing of any kind, and the like.
- Coating onto one or both surfaces of the wet tissue sheet, such as blade coating, air knife coating, short dwell coating, cast coating, and the like.
- Extrusion from a die head such as UFD spray tips, such as available from ITW-Dynatec of Henderson, Tenn., of the polysiloxane composition in the form of a solution, a dispersion or emulsion, or a viscous mixture.
- Impregnation of the wet tissue sheet with a solution or slurry, wherein the polysiloxane composition penetrates a significant distance into the thickness of the wet tissue sheet, such as about 20% or more of the thickness of the wet tissue sheet, more specifically about 30% or more and most specifically about 70% or more of the thickness of the wet tissue sheet, including completely penetrating the wet tissue sheet throughout the full extent of its thickness. One useful method for impregnation of a wet tissue sheet is the Hydra-Sizer® system, produced by Black Clawson Corp., Watertown, N.Y., as described in "New Technology to Apply Starch and Other Additives," Pulp and Paper Canada, 100(2): T42-T44 (February 1999). This system consists of a die, an adjustable support structure, a catch pan, and an additive supply system. A thin curtain of descending liquid or slurry is created which contacts the moving tissue sheet beneath it. Wide ranges of applied doses of the coating material are said to be achievable with good runnability. The system may also be applied to curtain coat a relatively dry tissue sheet and/or tissue product, such as a tissue sheet just before or after creping.
- Foam application of the polysiloxane composition to the wet fibrous tissue sheet (e.g., foam finishing), either for topical application or for impregnation of the compound into the tissue sheet and/or tissue product under the influence of a pressure differential (e.g., vacuum-assisted impregnation of the foam). Principles of foam application of additives such as binder agents are described in U.S. Pat. No. 4,297,860, issued on Nov. 3, 1981 to Pacifici et al. and U.S. Pat. No. 4,773,110, issued on Sep. 27, 1988 to G. J. Hopkins, the disclosures of both which are herein incorporated by reference to the extent that they are non-contradictory herewith.

Application of the polysiloxane composition by spray or other means to a moving belt or fabric which in turn contacts the tissue sheet and/or tissue product to apply the chemical to the tissue sheet, such as is disclosed in WO 01/49937 under the name of S. Eichhorn, published on Jun. 12, 2001.

Spraying an emulsion of the polysiloxane onto a heated transfer roll, partially evaporating the water or transport fluid and then applying to the tissue sheet and/or tissue product as described by Ampulski in U.S. Pat. No. 5,246,545 issued on Sep. 21, 1993.

While the method of application may vary in the present invention, it has been surprisingly found that when applied under certain conditions, specifically when applied as a neat fluid, the polysiloxane blends of the present invention may show improved hydrophilicity over the hydrophilic polysiloxane alone. While not wishing to be bound by theory it is hypothesized that when combined as neat fluids the viscosity of the polysiloxane blend is increased substantially. The increased viscosity of the polysiloxane blend causes reduced spreading of the silicone across the surface and less tendency of the polysiloxane to reorient under thermal aging conditions. Hence, such polysilolxane blends may actually show improved hydrophilicity over even the hydrophilic polysiloxane.

When topically applied, the polysiloxane composition may be applied to the tissue sheet and/or tissue product so as to cover substantially the entire tissue sheet and/or tissue product or may be applied in a pattern. For example, the polysiloxane composition may be applied to cover any where from about 20 percent to 100 percent of the surface area of the tissue sheet and/or tissue product. The polysiloxane composition may be applied to a single side or can be applied to both sides of the tissue sheet and/or tissue product. Further, when the tissue sheet and/or tissue product is a multi-ply product, the polysiloxane composition may be applied to the outer tissue sheets (plies) and/or the inner tissue sheets (plies).

In one embodiment of the present invention, the polysiloxane may be applied uniformly over the x-y direction of the tissue sheet and/or tissue product in a manner that about 50% or more, more specifically about 60% or more and still more specifically about 70% or more of the x-y plane of any side of the tissue sheet and/or tissue product which has polysiloxane applied. In a specific embodiment of the present invention, the polysiloxane composition may be applied to the surface of the tissue sheet and/or tissue product in a uniform pattern such that about 75% or more of the surface of the tissue sheet and/or tissue product is covered and such that the distance between treated and untreated areas does not exceed 0.5 mm. In another specific embodiment of the present invention, the polysiloxane composition may be applied in the wet end of the process prior to the tissue sheet forming process either by addition to a slurry of pulp fiber in water or by addition as pretreated pulp fibers as described in U.S. Pat. No. 6,582,560 issued to Runge, et. al., on Jun. 24, 2003. As such, the hydrophobic additive may be thus present uniformly in the sheet and that 100% of the x-y plane of the tissue sheet and/or tissue product containing the polysiloxane composition.

When the silicone is applied in a non-uniform manner to the tissue sheet and/or tissue product, it may be necessary to take the test specimen in a manner so as to replicate the repeat pattern in the tissue sheet and/or tissue product so the sample of the tissue sheet and/or tissue product has the same % area coverage as the rest of the tissue sheet and/or tissue product. For example, referring to FIG. 1, the shaded areas $a^1$, $a^2$, $a^3$ represent silicone treated areas on the tissue sheet and/or tissue product (p) while areas $b^1$ through $b^4$ represent untreated areas of the tissue sheet and/or tissue product. In FIG. 1, the silicone is applied in stripes in the machine direction. In such case, the test sample strip (C) is taken in the cross direction so that the sample of the tissue sheet and/or tissue product to be tested has the same ratio of treated to untreated regions as the entire tissue sheet and/or tissue product and hence same weight percent of polysiloxane as the tissue sheet and/or tissue product (p).

As an alternative, the tissue sheet and/or tissue product or a portion thereof may be dry fiberized to obtain a homogeneous distribution of silicone in the sample to be tested. Dry fiberization is a dry mechanical treatment in which the dry tissue sheet and/or tissue product is passed through a device, such as a hammermill, similar to a refiner; the resultant material is fluff pulp. Specific equipment and conditions are not important so long as parameters such as anvil gap and feed throughput are controlled so as to achieve good uniformity. This method may be required when using XRF spectroscopy to determine the amount of polysiloxane present in the tissue sheet and/or tissue product.

Uniformity of the polysiloxane in the x-y direction of the tissue sheet and/or tissue product may be determined using Micro-XRF imaging techniques. One suitable instrument for determining the X-Y silicone distribution is the Omnicron EDXRF system available from ThermoNoran, Inc., located in Madison, Wis. If the uniformity of the polysiloxane distribution in tissue sheet and/or tissue product can not be ascertained via the Micro-XRF imaging technique, another acceptable alternative is to pulp the entire tissue sheet and/or tissue product for 5 minutes at 2.5% consistency after soaking for 5 minutes. Approximately 2-liters of the pulp fiber slurry should then be taken and used to prepare tissue handsheets as described hereinafter.

While the primary use for the polysiloxane compositions of the present invention is for tissue sheets and/or tissue products such as bath tissue, facial tissue and towels, the polysiloxane compositions may be used in tissue products for a wide variety of applications, including, but not limited to wet wipes and other general wiping products where absorbency and soft hand feel are required. Tissue products as used herein are differentiated from other tissue products in terms of its bulk. The bulk of the tissue products of the present invention may be calculated as the quotient of the caliper (hereinafter defined), expressed in microns, divided by the basis weight, expressed in grams per square meter. The resulting bulk is expressed as cubic centimeters per gram. Writing papers, newsprint and other such papers have higher strength, stiffness and density (low bulk) in comparison to tissue products of the present invention which tend to have much higher calipers for a given basis weight. Where wet wipes are used bulk refers to the dry bulk of the tissue sheet and/or tissue product. The tissue products of the present invention have a bulk of about 2 $cm^3/g$ or greater, more specifically about 2.5 $cm^3/g$ or greater, and still more specifically about 3 $cm^3/g$ or greater.

The basis weight and caliper of the multi-ply tissue products of the present invention may vary widely and may be dependent on, among other things, the number of plies (tissue sheets). The caliper and bulk of the plies comprising non-treated pulp fibers may be of any value. The caliper of the individual ply or plies comprising the polysiloxane pretreated pulp fibers may be about 1200 microns or less, more specifically about 1000 microns or less, and still more specifically about 800 microns or less. The bulk of the individual ply or plies comprising the polysiloxane pretreated pulp fibers may be about 2 g/cm$^3$ or greater, more specifically about 2.5 g/cm$^3$ or greater, and most specifically about 3 g/cm$^3$ or greater.

It is often desirable to have the polysiloxane directed to at least one of the outer surfaces of the tissue sheet and/or tissue product. In a specific embodiment of the present invention, the tissue product is a 2-ply tissue product having two outward facing surfaces wherein the polysiloxane composition has been applied to both outward facing surfaces of the 2-ply tissue product. In another specific embodiment of the present invention, the tissue product is a multi-ply tissue product having three or more plies wherein the polysiloxane composition has been applied to both outward facing surfaces of the exterior 2 plies of the multi-ply tissue product and wherein the interior ply or plies contain substantially no polysiloxane. In still another specific embodiment of the present invention, the tissue product is a single ply tissue product wherein the polysiloxane composition has been applied to both outward facing surfaces of the single ply tissue product.

A wide variety of natural and synthetic pulp fibers are suitable for use in the tissue sheets and tissue products of the present invention. The pulp fibers may include fibers formed by a variety of pulping processes, such as kraft pulp, sulfite pulp, thermomechanical pulp, etc. In addition, the pulp fibers may consist of any high-average fiber length pulp, low-average fiber length pulp, or mixtures of the same.

One example of suitable high-average length pulp fibers includes softwood kraft pulp fibers. Softwood kraft pulp fibers are derived from coniferous trees and include pulp fibers such as, but not limited to, northern softwood, southern softwood, redwood, red cedar, hemlock, pine (e.g., southern pines), spruce (e.g., black spruce), combinations thereof, and the like. Northern softwood kraft pulp fibers may be used in the present invention. One example of commercially available northern softwood kraft pulp fibers suitable for use in the present invention include those available from Kimberly-Clark Corporation located in Neenah, Wis. under the trade designation of "Longlac-19".

Low-average length fibers are often used to increase the softness of a tissue sheet and/or tissue product. An example of suitable low-average length pulp fibers are the so called hardwood kraft pulp fibers. Hardwood kraft pulp fibers are derived from deciduous trees and include pulp fibers such as, but not limited to, eucalyptus, maple, birch, aspen, and the like. In certain instances, eucalyptus kraft pulp fibers may be particularly desired to increase the softness of the tissue sheet. Eucalyptus kraft pulp fibers may also enhance the brightness, increase the opacity, and change the pore structure of the tissue sheet to increase its wicking ability. Moreover, if desired, secondary pulp fibers obtained from recycled materials may be used, such as fiber pulp from sources such as, for example, newsprint, reclaimed paperboard, and office waste.

In tissue sheets and/or tissue products comprising a blend of hardwood kraft and softwood kraft pulp fibers, the overall ratio of hardwood kraft pulp fibers to softwood kraft pulp fibers within the tissue product and/or tissue sheets may vary broadly. However, in some embodiments of the present invention, tissue sheet and/or tissue products may comprise a blend of hardwood kraft pulp fibers and softwood kraft pulp fibers wherein the ratio of hardwood kraft pulp fibers to softwood kraft pulp fibers is from about 9:1 to about 1:9, more specifically from about 9:1 to about 1:4, and most specifically from about 9:1 to about 1:3. In one embodiment of the present invention, the hardwood kraft pulp fibers and softwood kraft pulp fibers (polysiloxane pretreated pulp fibers and/or non-treated pulp fibers) may be layered so as to give a heterogeneous distribution of hardwood kraft pulp fibers and softwood kraft pulp fibers in the z-direction of the tissue sheet and/or tissue product. In another embodiment of the present invention, the hardwood and softwood kraft pulp fibers may be combined in a blended tissue sheet and/or tissue product wherein the hardwood kraft pulp fibers and softwood kraft pulp fibers are distributed homogeneously within the z-direction of the tissue sheet and/or tissue product.

In addition, synthetic fibers may also be utilized. The discussion herein regarding pulp fibers is understood to include synthetic fibers. Some suitable polymers that may be used to form the synthetic fibers include, but are not limited to: polyolefins, such as, polyethylene, polypropylene, polybutylene, and the like; polyesters, such as polyethylene terephthalate, poly(glycolic acid) (PGA), poly(lactic acid) (PLA), poly(β-malic acid) (PMLA), poly(ε-caprolactone) (PCL), poly(ρ-dioxanone) (PDS), poly(3-hydroxybutyrate) (PHB), and the like; and, polyamides, such as nylon and the like. Synthetic or natural cellulosic polymers, including but not limited to: cellulosic esters; cellulosic ethers; cellulosic nitrates; cellulosic acetates; cellulosic acetate butyrates; ethyl cellulose; regenerated celluloses, such as viscose, rayon, and the like; cotton; flax; hemp; and mixtures thereof may be used in the present invention. The synthetic fibers may be located in any or all layers or plies of the tissue sheet and/or tissue product.

Another aspect of the present invention resides in a tissue sheet and/or tissue product comprising a mixture of hydrophobic polysiloxanes and hydrophilic polysiloxane containing a functional group capable of substantively attaching the hydrophilic polysiloxane to the pulp fibers. The tissue sheets and/or tissue products comprising the hydrophobic/hydrophilic polysiloxane blend are differentiated from known tissue sheets and/or tissue products comprising hydrophilic and hydrophobic polysiloxanes in that the tissue sheets and/or tissue products comprising the blend shows improved hydrophilicity, thermal aging performance and polysiloxane retention. Hence higher levels of the polysiloxane blends may be incorporated into the tissue sheets and/or tissue products of the present invention to supply additional softness benefits to those tissue sheets and/or tissue products or equivalent softness may be obtained at lower levels of polysiloxane to create more economical soft polysiloxane pretreated tissue sheets and/or tissue products.

Another embodiment of the present invention is a method for making a polysiloxane pretreated tissue sheet and/or tissue product having a high level of polydialkylsiloxane, yet having good hydrophilicity. Furthermore, the tissue making process creates polysiloxane treated tissue sheets and/or tissue products having high levels of silicone retention when repulped, yet when repulped, the hydrophilic properties are retained despite the high level of polydialkylsiloxane. Such a tissue making process comprises blending a hydrophilic aminofunctional polysiloxane with a hydrophobic polysiloxane such as an aminofunctional polydialkylsiloxane and topically applying the blended composition to a formed tissue sheet and/or tissue product.

In a specific embodiment of the present invention, at least a portion of the polysiloxane is delivered to the tissue sheet and/or tissue product via polysiloxane pretreated pulp fibers. The preparation of polysiloxane pretreated pulp fibers may be accomplished by methods such as those described in U.S. Pat. No. 6,582,560 issued to Runge, et. al., on Jun. 24, 2003. It has been found that pulp fibers treated with polysiloxane in this manner demonstrate excellent retention of the polysiloxane through the tissue making process. The polysiloxane pretreated pulp fibers may contain from about 0.1% to about 10% polysiloxane by weight, more specifically from about 0.2% to about 4% polysiloxane by weight, and most specifically from about 0.3% polysiloxane to about 3% polysiloxane by weight. The polysiloxane pretreated pulp fibers may be blended with non-treated polysiloxane pulp fibers in the tissue sheets and/or tissue products. The amount of pretreated pulp fiber incorporated into the tissue sheet and/or tissue product may range from about 5% to about 100%.

The tissue sheet and/or tissue product to be treated may be made by any method known in the art. For example, the tissue sheet and/or tissue product may be wetlaid, such as a tissue sheet formed with known papermaking techniques wherein a dilute aqueous pulp fiber slurry is disposed on a moving wire to filter out the pulp fibers and form an embryonic web which is subsequently dewatered by combinations of units including suction boxes, wet presses, dryer units, and the like. Examples of known dewatering and other operations are given in U.S. Pat. No. 5,656,132, issued on Aug. 12, 1997 to Farrington et al. Capillary dewatering can also be applied to remove water from the web, as disclosed in U.S. Pat. No. 5,598,643 issued on Feb. 4, 1997 and U.S. Pat. No. 4,556,450 issued on Dec. 3, 1985, both to S. C. Chuang et al. Other methods for manufacturing the tissue sheets and/or tissue product to be treated include but is not limited to such processes as airlaid, coform, and hydroentagling.

For the tissue sheets and/or tissue product of the present invention, both creped and uncreped methods of manufacture may be used. Uncreped tissue production is disclosed in U.S. Pat. No. 5,772,845, issued on Jun. 30, 1998 to Farrington, Jr. et al., the disclosure of which is herein incorporated by reference to the extent it is non-contradictory herewith. Creped tissue production is disclosed in U.S. Pat. No. 5,637,194, issued on Jun. 10, 1997 to Ampulski et al.; U.S. Pat. No. 4,529,480, issued on Jul. 16, 1985 to Trokhan; U.S. Pat. No. 6,103,063, issued on Aug. 15, 2000 to Oriaran et al.; and, U.S. Pat. No. 4,440,597, issued on Apr. 3, 1984 to Wells et al., the disclosures of all of which are herein incorporated by reference to the extent that they are non-contradictory herewith. Also suitable for application of the above mentioned polysiloxanes are tissue sheets and/or tissue products that are pattern densified or imprinted, such as the webs disclosed in any of the following U.S. Pat. No. 4,514,345, issued on Apr. 30, 1985 to Johnson et al.; U.S. Pat. No. 4,528,239, issued on Jul. 9, 1985 to Trokhan; U.S. Pat. No. 5,098,522, issued on Mar. 24, 1992; U.S. Pat. No. 5,260,171, issued on Nov. 9, 1993 to Smurkoski et al.; U.S. Pat. No. 5,275,700, issued on Jan. 4, 1994 to Trokhan; U.S. Pat. No. 5,328,565, issued on Jul. 12, 1994 to Rasch et al.; U.S. Pat. No. 5,334,289, issued on Aug. 2, 1994 to Trokhan et al.; U.S. Pat. No. 5,431,786, issued on Jul. 11, 1995 to Rasch et al.; U.S. Pat. No. 5,496,624, issued on Mar. 5, 1996 to Steltjes, Jr. et al.; U.S. Pat. No. 5,500,277, issued on Mar. 19, 1996 to Trokhan et al.; U.S. Pat. No. 5,514,523, issued on May 7, 1996 to Trokhan et al.; U.S. Pat. No. 5,554,467, issued on Sep. 10, 1996 to Trokhan et al.; U.S. Pat. No. 5,566,724, issued on Oct. 22, 1996 to Trokhan et al.; U.S. Pat. No. 5,624,790, issued on Apr. 29, 1997 to Trokhan et al.; and, U.S. Pat. No. 5,628,876, issued on May 13, 1997 to Ayers et al., the disclosures of all of which are herein incorporated by reference to the extent that they are non-contradictory herewith. Such imprinted tissue sheets and/or tissue product may have a network of densified regions that have been imprinted against a drum dryer by an imprinting fabric, and regions that are relatively less densified (e.g., "domes" in the tissue sheet) corresponding to deflection conduits in the imprinting fabric, wherein the tissue sheet and/or tissue product superposed over the deflection conduits was deflected by an air pressure differential across the deflection conduit to form a lower-density pillow-like region or dome in the tissue sheet and/or tissue product.

Various drying operations may be useful in the manufacture of the tissue sheets and/or tissue products of the present invention. Examples of such drying methods include, but are not limited to, drum drying, through drying, steam drying such as superheated steam drying, displacement dewatering, Yankee drying, infrared drying, microwave drying, radiofrequency drying in general, and impulse drying, as disclosed in U.S. Pat. No. 5,353,521, issued on Oct. 11, 1994 to Orloff and U.S. Pat. No. 5,598,642, issued on Feb. 4, 1997 to Orloff et al., the disclosures of both which are herein incorporated by reference to the extent that they are non-contradictory herewith. Other drying technologies may be used, such as methods employing differential gas pressure include the use of air presses as disclosed U.S. Pat. No. 6,096,169, issued on Aug. 1, 2000 to Hermans et al. and U.S. Pat. No. 6,143,135, issued on Nov. 7, 2000 to Hada et al., the disclosures of both which are herein incorporated by reference to the extent they are non-contradictory herewith. Also relevant are the paper machines disclosed in U.S. Pat. No. 5,230,776, issued on Jul. 27, 1993 to I. A. Andersson et al.

Optional chemical additives may also be added to the aqueous pulp fiber slurries of the present invention and/or to the embryonic tissue sheet to impart additional benefits to the tissue sheet and/or tissue product and process and are not antagonistic to the intended benefits of the present invention. The following chemical additives are examples of additional chemical treatments that may be applied to the polysiloxane treated tissue sheets and/or tissue products of the present invention. The chemical additives are included as examples and are not intended to limit the scope of the present invention. Such chemical additives may be added at any point in the papermaking process, before or after the formation of the tissue sheet and/or tissue product. The chemical additives may also be added in conjunction with the polysiloxane during the treatment process.

It is also understood that the optional chemical additives may be employed in specific layers of the tissue sheet and/or tissue product or may be employed throughout the tissue sheet and/or tissue product as broadly known in the art. For example, in a layered tissue sheet and/or tissue product configuration, strength agents may be applied only to the layer of the tissue sheet and/or tissue product comprising softwood pulp fibers and/or bulk debonders may be applied only to the layer of the tissue sheet and/or tissue product comprising hardwood pulp fibers. While significant migration of the chemical additives into the other untreated layers of the tissue sheet and/or tissue product may occur, benefits may be further realized than when the chemical additives are applied to all layers of the tissue sheet and/or tissue product on an equal basis. Such layering of the optional chemical additives may be useful in the present invention.

Charge promoters and control agents are commonly used in the papermaking process to control the zeta potential of the papermaking furnish in the wet end of the process. These species may be anionic or cationic, most usually cationic, and may be either naturally occurring materials such as alum or low molecular weight high charge density synthetic polymers typically of molecular weight less than 500,000. Drainage and retention aids may also be added to the furnish to improve formation, drainage and fines retention. Included within the retention and drainage aids are microparticle systems containing high surface area, high anionic charge density materials.

Wet and dry strength agents may also be applied to the tissue sheet and/or tissue product. As used herein, the term "wet strength agents" are materials used to immobilize the bonds between pulp fibers in the wet state. Typically, the means by which pulp fibers are held together in tissue sheets and tissue products involve hydrogen bonds and sometimes combinations of hydrogen bonds and covalent and/or ionic bonds. In the present invention, it may be useful to provide a material that will allow bonding of pulp fibers in such a way as to immobilize the fiber-to-fiber bond points and make the pulp fibers resistant to disruption in the wet state. In this instance, the wet state usually will mean when the tissue sheet and/or tissue product is largely saturated with water or other aqueous solutions, but could also mean significant saturation with body fluids such as urine, blood, mucus, menses, runny bowel movement, lymph and other body exudates.

Any material that when added to a tissue sheet and/or tissue product results in providing the tissue sheet or tissue product with a mean wet geometric tensile strength:dry geometric tensile strength ratio in excess of 0.1 will, for purposes of the present invention, be termed a wet strength agent. Typically these materials are termed either as permanent wet strength agents or as "temporary" wet strength agents. For the purposes of differentiating permanent wet strength agents from temporary wet strength agents, the permanent wet strength agents will be defined as those resins which, when incorporated into tissue sheets or tissue products, will provide a tissue product that retains more than about 50% of its original wet strength after being saturated with water for a period of at least five minutes. Temporary wet strength agents are that provide a tissue product that retains less than about 50% of its original wet strength after being saturated with water for five minutes. Both classes of material may find application in the present invention. The amount of wet strength agent that may be added to the pulp fibers may be about 0.1 dry weight percent or greater, more specifically about 0.2 dry weight percent or greater, and still more specifically from about 0.1 to about 3 dry weight percent, based on the dry weight of the pulp fibers.

Permanent wet strength agents will provide a more or less long-term wet resilience to the structure of a tissue sheet or tissue product. In contrast, the temporary wet strength agents will typically provide tissue sheet or tissue product structures that had low density and high resilience, but would not provide a structure that had long-term resistance to exposure to water or body fluids.

Temporary wet strength additives may be cationic, nonionic or anionic. Examples of such temporary wet strength additives include PAREZ™ 631 NC and PAREZ® 725 temporary wet strength resins that are cationic glyoxylated polyacrylamides available from Cytec Industries, located at West Paterson, N.J. These and similar resins are described in U.S. Pat. No. 3,556,932, issued to Coscia et al. and U.S. Pat. No. 3,556,933, issued to Williams et al. Hercobond 1366, manufactured by Hercules, Inc. located at Wilmington, Del. is another commercially available cationic glyoxylated polyacrylamide that may be used with the present invention. Additional examples of temporary wet strength additives include dialdehyde starches such as Cobond 1000® commercially available from National Starch and Chemical Company and other aldehyde containing polymers such as those described in U.S. Pat. No. 6,224,714, issued on May 1, 2001 to Schroeder et al.; U.S. Pat. No. 6,274,667, issued on Aug. 14, 2001 to Shannon et al.; U.S. Pat. No. 6,287,418, issued on Sep. 11, 2001 to Schroeder et al.; and, U.S. Pat. No. 6,365,667, issued on Apr. 2, 2002 to Shannon et al., the disclosures of all of which are herein incorporated by reference to the extent that they are non-contradictory herewith.

Permanent wet strength agents comprising cationic oligomeric or polymeric resins may be used in the present invention. Polyamide-polyamine-epichlorohydrin type resins such as KYMENE 557H sold by Hercules, Inc. located at Wilmington, Del. are the most widely used permanent wet-strength agents and are suitable for use in the present invention. Such materials have been described in the following U.S. Pat. Nos.: 3,700,623, issued on Oct. 24, 1972 to Keim; U.S. Pat. No. 3,772,076, issued on Nov. 13, 1973 to Keim; U.S. Pat. No. 3,855,158, issued on Dec. 17, 1974 to Petrovich et al.; U.S. Pat. No. 3,899,388, issued on Aug. 12, 1975 to Petrovich et al.; U.S. Pat. No. 4,129,528, issued on Dec. 12, 1978 to Petrovich et al.; U.S. Pat. No. 4,147,586, issued on Apr. 3, 1979 to Petrovich et al.; and, U.S. Pat. No. 4,222,921, issued on Sep. 16, 1980 to van Eenam. Other cationic resins include polyethylenimine resins and aminoplast resins obtained by reaction of formaldehyde with melamine or urea. Permanent and temporary wet strength resins may be used together in the manufacture of tissue sheets and tissue products with such use being recognized as falling within the scope of the present invention.

Dry strength resins may also be applied to the tissue sheet without affecting the performance of the disclosed polysiloxanes of the present invention. Such materials may include, but are not limited to, modified starches and other polysaccharides such as cationic, amphoteric, and anionic starches and guar and locust bean gums, modified polyacrylamides, carboxymethylcellulose, sugars, polyvinyl alcohol, chitosan, and the like. Such dry strength additives are typically added to the pulp fiber slurry prior to the formation of the tissue sheet or as part of the creping package.

It may be desirable to add additional debonders or softening chemistries to a tissue sheet. Such softness additives may be found to further enhance the hydrophilicity of the finished tissue product. Examples of debonders and softening chemistries may include the simple quaternary ammonium salts having the general formula $(R^{1''})_{4-b}—N^{+}—(R^{1''})_b$ $X^{-}$ wherein $R^1$ is a $C_{1-6}$ alkyl group, $R^{1''}$ is a $C_{14}$-$C_{22}$ alkyl group, b is an integer from 1 to 3 and X' is any suitable counterion. Other similar compounds may include the monoester, diester, monoamide, and diamide derivatives of the simple quaternary ammonium salts. A number of variations on these quaternary ammonium compounds should be considered to fall within the scope of the present invention. Additional softening compositions include cationic oleyl imidazoline materials such as methyl-1-oleyl amidoethyl-2-oleyl imidazo linium methylsulfate commercially available as Mackernium CD-183 from McIntyre Ltd., located in University Park, Ill. and Prosoft TQ-1003 available from Hercules, Inc. Such softeners may also incorporate a humectant or a plasticizer such as a low molecular weight polyethylene glycol (molecular weight of about 4,000 daltons or less) or a polyhydroxy compound such as glycerin or propylene glycol. These softeners may be applied to the pulp fibers while in a pulp fiber slurry prior to the formation of a tissue sheet to aid in bulk softness. At times, it may be desirable to add such secondary softening agents simultaneously with the polysiloxanes of the present invention. In such cases, solutions or emulsions of the softening composition and polysiloxane may be blended.

Additional types of chemical additives that may be added to the tissue sheet include, but is not limited to, absorbency aids usually in the form of cationic, anionic, or non-ionic surfactants, humectants and plasticizers such as low molecular weight polyethylene glycols and polyhydroxy compounds such as glycerin and propylene glycol. Materials, skin health benefit agents, that supply skin health benefits or other benefits such as mineral oil, aloe extract, waxes including hydrocarbon waxes, petrolatums, tocopherols such as vitamin e and the like may also be incorporated into the tissue sheet and/or tissue product.

In general, the polysiloxane compositions of the present invention may be used in conjunction with any known materials and chemical additives that are not antagonistic to their intended use. Examples of such materials include specialty additives such as, but not limited to, odor control agents, such as odor absorbents, activated carbon fibers and particles, baby powder, baking soda, chelating agents, zeolites, perfumes or other odor-masking agents, cyclodextrin compounds, oxidizers, and the like, superabsorbent particles, synthetic fibers, or films may also be employed. Additional options include cationic dyes, optical brighteners, humectants, emollients, and the like. A wide variety of other materials and chemical additives known in the art of tissue-making production may be included in the tissue sheets of the present invention.

The application point for these materials and chemical additives is not particularly relevant to the invention and such materials and chemical additives may be applied at any point in the tissue manufacturing process. This includes pretreatment of pulp, application in the wet end of the process, post-treatment after drying but on the tissue machine and topical post-treatment.

Analytical Methods

Total Polysiloxane in Sheet

The polysiloxane content on the pulp fiber substrates was determined using the following procedure. A sample containing dimethyl siloxane is placed in a headspace vial, boron trifluoride reagent is added, and the vial sealed. After reacting for about fifteen minutes at about 100° C., the resulting Diflourodimethyl siloxane in the headspace of the vial is measured by gas chromatography using an FID detector.

$$3Me_2SiO+2BF_3.O(C_2H_5)_2 \rightarrow 3Me_2SiF_2+B_2O_3+2(C_2H_5)_2O$$

The method described herein was developed using a Hewlett-Packard Model 5890 Gas Chromatograph with an FID and a Hewlett-Packard 7964 autosampler. An equivalent gas chromatography system may be substituted.

The instrument was controlled by, and the data collected using, Perkin-Elmer Nelson Turbochrom software (version 4.1). An equivalent software program may be substituted. A J&W Scientific GSQ (30 m×0.53 mm i.d.) column with film thickness 0.25 μm, Cat. # 115–3432 was used. An equivalent column may be substituted.

The gas chromatograph was equipped with a Hewlett-Packard headspace autosampler, HP-7964 and set up at the following conditions.

| | |
|---|---|
| Bath Temperature: 100° C. | Loop Temperature: 110° C. |
| Transfer Line Temperature: 120° C. | GC Cycle Time: 25 minutes |
| Vial Equilibrium Time: 15 minutes | Pressurize Time: 0.2 minutes |

-continued

| | |
|---|---|
| Loop Fill Time: 0.2 minutes | Loop Equil. Time: 0.05 minutes |
| Inject Time: 1.0 minute | Vial Shake: 1 (Low) |

The Gas Chromatograph was set to the following instrument conditions:

Carrier gas: Helium

Flow rate: 16.0 mL through column and 14 mL make-up at the detector.

Injector Temperature: 150° C.

Detector Temperature: 220° C.

Chromatography Conditions:

50° C. for 4 minutes with a ramp of 10° C./minute to 150° C.

Hold at final temperature for 5 minutes.

Retention Time: 7.0 min. for DFDMS

A stock solution containing approximately 5000 μg/ml of the polysiloxane was prepared in the following manner. Approximately 1.25 grams of the polysiloxane emulsion is weighed to the nearest 0.1 mg into a 250-ml volumetric flask. The actual weight (represented as X) is recorded. Distilled water is added and the flask swirled to dissolve/disperse the emulsion. When dissolved/dispersed, the emulsion is diluted to volume with water and mixed. The ppm of the polysiloxane emulsion (represented as Y) is calculated from the following equation:

$$PPM \text{ polysiloxane emulsion } Y=X/0.250$$

The Calibration Standards are made to bracket the target concentration by adding 0 (blank), 50, 100, 250, and 500 μL of the Stock Solution (the volume in uL $V_c$ recorded) to successive 20 mL headspace vials containing 0.1±0.001 grams of an untreated control tissue sheet. The solvent is evaporated by placing the headspace vials in an oven at a temperature ranging between about 60 to about 70° C. for 15 minutes. The μg of emulsion (represented as Z) for each calibration standard is calculated from the following equation:

$$Z=Vc*Y/1000$$

The calibration standards are then analyzed according to the following procedure: 0.100±0.001 g sample of a tissue sheet is weighed to the nearest 0.1 mg into a 20-ml headspace vial. The sample weight (represented as $W_s$) in mg is recorded. The amount of tissue sheet taken for the standards and samples must be the same.

100 μL of $BF_3$ reagent is added to each of the tissue sheet samples and calibration standards. Each vial is sealed immediately after adding the $BF_3$ reagent.

The sealed vials are placed in the headspace autosampler and analyzed using the conditions described previously, injecting 1 mL of the headspace gas from each tissue sheet sample and calibration standard.

A calibration curve of μg emulsion versus analyte peak area is prepared.

The analyte peak area of the tissue sheet sample is then compared to the calibration curve and amount of polysiloxane emulsion (represented as (A)) in μg on the tissue sheet determined.

The amount of polysiloxane emulsion (represented as (C)) in percent by weight on the tissue sample is computed using the following equation:

$$(C)=(A)/(W_s*10^4)$$

The amount of the polysiloxane (represented as (D)) in percent by weight on the tissue sheet sample is computed using the following equation and the weight % polysiloxane (represented as (F)) in the emulsion:

$$(D)=(C)*(F)/100$$

Polydialkylsiloxane Content

The polydialkylsiloxane content on pulp fiber substrates was determined using the following procedure. A sample containing the appropriate polydialkylsiloxane is placed in a headspace vial, boron trifluoride reagent is added, and the vial sealed. After reacting for about fifteen minutes at about 100° C., the resulting Diflourodimethyl siloxane in the headspace of the vial is measured by gas chromatography with an FID detector.

$$3Me_2SiO+2BF_3.O(C_2H_5)_2 \rightarrow 3Me_2SiF_2+B_2O_3+2(C_2H_5)_2O$$

The method described herein was developed using a Hewlett-Packard Model 5890 Gas Chromatograph with an FID and a Hewlett-Packard 7964 autosampler. An equivalent gas chromatography system may be substituted.

The instrument was controlled by, and the data collected using, Perkin-Elmer Nelson Turbochrom software (version 4.1). An equivalent software program may be substituted. A J&W Scientific GSQ (30 m×0.53 mm i.d.) column with film thickness 0.25 μm, Cat. # 115–3432 was used. An equivalent column may be substituted.

The gas chromatograph was equipped with a Hewlett-Packard headspace autosampler, HP-7964 and set up at the following conditions:

| | |
|---|---|
| Bath Temperature: 100° C. | Loop Temperature: 110° C. |
| Transfer Line Temperature: 120° C. | GC Cycle Time: 25 minutes |
| Vial Equilibrium Time: 15 minutes | Pressurize Time: 0.2 minutes |
| Loop Fill Time: 0.2 minutes | Loop Equil. Time: 0.05 minutes |
| Inject Time: 1.0 minute | Vial Shake: 1 (Low) |

The gas chromatograph was set to the following instrument conditions:

Carrier gas: Helium

Flow rate: 16.0 mL through column and 14 mL make-up at the detector.

Injector Temperature: 150° C.

Detector Temperature: 220° C.

Chromatography Conditions:

50° C. for 4 minutes with a ramp of 10° C./minute to 150° C.

Hold at final temperature for 5 minutes.

Retention Time: 7.0 min. for DFDMS

Preparation of Stock Solution

The method is calibrated to pure PDMS or other appropriate polydialkylsiloxane. Polydimethylsiloxane is calibrated using DC-200 fluid available from Dow Corning, Midland, Mich. A stock solution containing about 1250 μg/ml of the DC-200 fluid is prepared in the following manner. About 0.3125 grams of the DC-200 fluid is weighed to the nearest 0.1 mg into a 250-ml volumetric flask. The actual weight (represented as X) is recorded. A suitable solvent such as methanol, MIBK or chloroform is added and the flask swirled to dissolve/disperse the fluid. When dissolved the solution is diluted to volume with solvent and mixed. The ppm of dimethylpolysiloxane (represented as Y) is calculated from the following equation:

$$PPM \text{ of dimethylpolysiloxane } (Y)=X/0.250$$

Preparation of Calibration Standards

The Calibration Standards are made to bracket the target concentration by adding 0 (blank), 50, 100, 250, and 500 μL of the Stock Solution (the volume in uL $V_c$ recorded) to successive 20 mL headspace vials containing 0.1±0.001 grams of an untreated control tissue web or tissue product. The solvent is evaporated by placing the headspace vials in an oven at a temperature ranging between about 60° C. to about 70° C. for about 15 minutes. The μg of dimethylpolysiloxane (represented as Z) for each calibration standard is calculated from the following equation:

$$Z=Vc*Y/1000$$

Analytical Procedure

The calibration standards are then analyzed according to the following procedure: 0.100±0.001 g of tissue sample is weighed to the nearest 0.1 mg into a 20-ml headspace vial. The sample weight (represented as $W_s$) in mg is recorded. The amount of tissue web and/or tissue product taken for the standards and samples must be the same.

100 μL of $BF_3$ reagent is added to each of the samples and calibration standards. Each vial is sealed immediately after adding the $BF_3$ reagent.

The sealed vials are placed in the headspace autosampler and analyzed using the conditions described previously, injecting 1 mL of the headspace gas from each tissue sample and standard.

Calculations

A calibration curve of μg dimethylpolysiloxane versus analyte peak area is prepared.

The analyte peak area of the tissue sample is then compared to the calibration curve and amount of polydimethylsiloxane (represented as (A)) in μg on the tissue web and/or tissue product is determined.

The amount of polydimethylsiloxane (represented as (C)) in percent by weight on the tissue sample is computed using the following equation:

$$(C)=(A)/(W_s*10^4)$$

The amount of the polydimethylsiloxane (represented as (D)) in percent by weight on the tissue sample is computed using the following equation:

$$(D)=(C)/100$$

When polydialkylsiloxanes other than dimethylpolysiloxane are present, calibration standards are made from representative samples of the pure polydialkylsiloxanes that are present and the amount of each polydialkylsiloxane is determined as in the method above for polydimethylsiloxane. The sum of the individual polydialkylsiloxane amounts is then used for the total amount of polydialkylsiloxane present in the tissue web and/or tissue product.

Basis Weight Determination (Tissue)

The basis weight and bone dry basis weight of the tissue sheet specimens was determined using a modified TAPPI T410 procedure. As is basis weight samples were conditioned at 23° C.±1° C. and 50±2% relative humidity for a minimum of 4 hours. After conditioning a stack of 16–3"×3" samples was cut using a die press and associated die. This represents a tissue sheet sample area of 144 $in^2$. Examples of suitable die presses are TMI DGD die press manufactured by Testing Machines, Inc. located at Islandia, N.Y., or a Swing Beam testing machine manufactured by USM Corporation, located at Wilmington, Mass. Die size tolerances are +/−0.008 inches in both directions. The specimen stack is then weighed to the nearest 0.001 gram on a tared analytical balance. The basis weight in pounds per 2880 $ft^2$ is then calculated using the following equation:

$$\text{Basis weight}=\text{stack wt. In grams}/454*2880$$

The bone dry basis weight is obtained by weighing a sample can and sample can lid to the nearest 0.001 grams (this weight is A). The sample stack is placed into the sample can and left uncovered. The uncovered sample can and stack along with sample can lid is placed in a 105° C.±2° C. oven for a period of 1 hour±5 minutes for sample stacks weighing less than 10 grams and at least 8 hours for sample stacks weighing 10 grams or greater. After the specified oven time has lapsed, the sample can lid is placed on the sample can and the sample can removed from the oven. The sample can is allowed to cool to approximately ambient temperature but no more than 10 minutes. The sample can, sample can lid, and sample stack are then weighed to the nearest 0.001 gram (this weight is C). The bone dry basis weight in pounds/2880 $ft^2$ is calculated using the following equation:

$$\text{Bone Dry } BW=(C-A)/454*2880$$

Dry Tensile (Tissue)

The Geometric Mean Tensile (GMT) strength test results are expressed as grams-force per 3 inches of sample width. GMT is computed from the peak load values of the MD (machine direction) and CD (cross-machine direction) tensile curves, which are obtained under laboratory conditions of 23.0° C.±1.0° C., 50.0±2.0% relative humidity, and after the tissue sheet has equilibrated to the testing conditions for a period of not less than four hours. Testing is conducted on a tensile testing machine maintaining a constant rate of elongation, and the width of each specimen tested was 3 inches. The "jaw span" or the distance between the jaws, sometimes referred to as gauge length, is 2.0 inches (50.8 mm). The crosshead speed is 10 inches per minute (254 mm/min.) A load cell or full-scale load is chosen so that all peak load results fall between 10 and 90 percent of the full-scale load. In particular, the results described herein were produced on an Instron 1122 tensile frame connected to a Sintech data acquisition and control system utilizing IMAP software running on a "486 Class" personal computer. This data system records at least 20 load and elongation points per second. A total of 10 specimens per sample are tested with the sample mean being used as the reported tensile value. The geometric mean tensile is calculated from the following equation:

$$GMT=(MD\ \text{Tensile}*CD\ \text{Tensile})^{1/2}$$

To account for small variations in basis weight, GMT values were then corrected to the 18.5 pounds/2880 $ft^2$ target basis weight using the following equation:

$$\text{Corrected } GMT=\text{Measured } GMT*(18.5/\text{Bone Dry Basis Weight})$$

Wet Out Time

The Wet Out Time of a tissue sheet and/or tissue product treated in accordance with the present invention is determined by cutting 20 sheets of the sample of the tissue sheet and/or tissue product into 2.5 inch squares. The number of sheets of the sample of tissue sheet and/or tissue product used in the test is independent of the number of plies per sheet of the sample of the tissue sheet and/or tissue product. The 20 square sheets of the sample of the tissue sheet and/or tissue product are stacked together and stapled at each corner to form a pad of the sample of the tissue sheet and/or tissue product. The pad of the sample of the tissue sheet and/or tissue product is held close to the surface of a constant temperature distilled water bath (23° C.±2° C.), which is the appropriate size and depth to ensure the saturated pad of the sample of the tissue sheet and/or tissue product does not contact the bottom of the water bath container and the top surface of the distilled water of the water bath at the same time, and dropped flat onto the surface of the distilled water, with staple points on the pad of the sample of the tissue sheet and/or tissue product facing down. The time necessary for the pad of the sample of the tissue sheet and/or tissue product to become completely saturated, measured in seconds, is the Wet Out Time for the tissue sheet sample and represents the absorbent rate of the sample of the tissue sheet and/or tissue product. Increases in the Wet Out Time represent a decrease in absorbent rate of the sample of the tissue sheet and/or tissue product. The test is stopped at 300 seconds with any sheet not wetting out in that period given a value of about 300 seconds or greater.

Water Drop Test

Initial water drop values are measured after conditioning the samples at 23.0° C.±1.0° C., 50.0±2.0% relative humidity for a period of at least 4 hours. Aged water drop values are measured after aging the handsheets at 85° C. in a forced air convection oven for a period of one hour. After aging the samples are cooled and conditioned at 23.0° C.±1.0° C., 50.0±2.0% relative humidity for a period of at least 4 hours.

A 2"×2" sample or larger of the aged or conditioned handsheet is cut from the handsheet. The actual dimension is not critical so long as the entire area is not wet out upon absorption of the water drop. The test sample is placed on a dry, non-porous surface such as a lab bench or flat acrylic or glass plate. 100 microliters, 0.1±0.01 ml. of distilled water (23.0° C.±1.0° C.) is dispensed immediately from an Eppendorf style pipet positioned slightly above the surface of the test specimen. The drop should be positioned close to the center of the specimen. The water drop is viewed on a plane horizontal to the surface of the test specimen. A stopwatch is started immediately after the water is dispensed onto the test specimen. The time in seconds for the water drop to completely be absorbed by the sample is determined by recording the time it takes for the water drop to completely disappear into the horizontal direction, that is, there is no vertical element to the water drop when viewed from the horizontal plane of the sample. This time is referred to as the water drop test value. The procedure is repeated 3 times and the average time recorded for the water drop test value. If after 3 minutes the sample is not completely absorbed the test is stopped and the time recorded as greater than 3 minutes.

Handsheet Preparation 50 grams of the chemically treated pulp fiber was soaked for 5 minutes in approximately 2-liters of tap water and then dispersed for 5 minutes in a British Pulp Disintegrator such as available from Lorentzen and Wettre, Atlanta, Ga. As an alternative, two liters of an approximately 2.5% consistency of the slurry of the pulped silicone pretreated pulp fibers may be used if it is necessary to use more than 25 grams of pulp fibers. The slurry is then diluted with water to a volume of 8 liters (0.625% consistency) and mixed with a mechanical stirrer at moderate agitation for a period of 5 minutes. Handsheets were made with a basis weight of 60 gsm.

During handsheet formation, the appropriate amount of pulp fiber (0.625% consistency) slurry required to make a 60 gsm sheet was measured into a graduated cylinder. The slurry was then poured from the graduated cylinder into an 8.5-inch by 8.5-inch Valley handsheet mold (Valley Laboratory Equipment, Voith, Inc.) that had been pre-filled to the appropriate level with water. After pouring the slurry into the mold, the mold was then completely filled with water, including water used to rinse the graduated cylinder. The slurry was then agitated gently with a standard perforated mixing plate that was inserted into the slurry and moved up and down seven times, then removed. The water was then drained from the mold through a wire assembly at the bottom of the mold that retains the pulp fibers to form an embryonic tissue sheet. The forming wire is a 90×90 mesh, stainless-steel wire cloth. The embryonic tissue sheet is couched from the mold wire with two blotter papers placed on top of the tissue sheet with the smooth side of the blotter contacting the embryonic tissue sheet. The blotters are removed and the embryonic tissue sheet is lifted with the lower blotter paper, to which it is attached. The lower blotter is separated from the other blotter, keeping the embryonic tissue sheet attached to the lower blotter. The blotter is positioned with the embryonic tissue sheet face up, and the blotter is placed on top of two other dry blotters. Two more dry blotters are also placed on top of the embryonic tissue sheet. The stack of blotters with the embryonic tissue sheet is placed in a Valley hydraulic press and pressed for one minute with 100 psi applied to the embryonic tissue sheet. The pressed embryonic tissue sheet was removed from the blotters and placed on a Valley steam dryer containing steam at 2.5 psig pressure and heated for 2 minutes, with the wire-side surface of the embryonic tissue sheet next to the metal drying surface and a felt under tension on the opposite side of the embryonic tissue sheet. Felt tension was provided by a 17.5 lbs of weight pulling downward on an end of the felt that extends beyond the edge of the curved metal dryer surface. The dried handsheet is trimmed to 7.5 inches square with a paper cutter.

Caliper

The term "caliper" as used herein is the thickness of a single tissue sheet, and may either be measured as the thickness of a single tissue sheet or as the thickness of a stack of ten tissue sheets and dividing the ten tissue sheet thickness by ten, where each sheet within the stack is placed with the same side up. Caliper is expressed in microns. Caliper was measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" optionally with Note 3 for stacked tissue sheets. The micrometer used for carrying out T411 om-89 is a Bulk Micrometer (TMI Model 49-72-00, Amityville, N.Y.) or equivalent having an anvil diameter of 4 1/16 inches (103.2 millimeters) and an anvil pressure of 220 grams/square inch (3.3 g kilo Pascals).

Sensory Softness

Sensory softness is an assessment of tissue sheet in-hand feel softness. This panel is lightly trained so as to provide assessments closer to those a consumer might provide. The strength lies in its generalizability to the consumer population. This softness measure is employed when the purpose is to obtain a holistic overview of attributes of the tissue sheets and/or tissue products and to determine if differences in the tissue sheets and/or tissue products are humanly perceivable.

The following is the specific softness procedure the panelists utilize while evaluating sensory softness for bath, facial and towel products. Samples of tissue sheets and/or tissue products are placed across the non-dominant arm with the coded side facing up. The pads of the thumb, index, and middle fingers of the dominant hand are then moved in a circular motion lightly across several areas of the sample. The velvety, silky, and fuzzy feel of the samples of the tissue sheets and/or tissue products is evaluated. Both sides of the samples are evaluated in the same manner. The procedure is then repeated for each additional sample in a paired comparison analysis.

The sensory softness data results are analyzed using a Freidman Two-Way Analysis of Variance (ANOVA) by Ranks. This analysis is a non-parametric test used for ranking data. The purpose is to determine if there is a difference between different experimental treatments. If there is not a ranking difference between the different experimental treatments, it is reasoned that the median response for one treatment is not statistically different than the median response of the other treatment, or any difference is caused by chance. The difference between the samples can be reported in terms of a preference of one code over another as a ratio of 100. For example, when comparing a sample vs. a control the softness preference can be expressed in terms of x/y where x is the number of respondents out of 100 that would state x is softer than y and y is the number of respondents out of 100 that would state y is softer than x in a paired comparison test.

Sensory softness is assessed by between 10 to 12 panelists applying a rank order paradigm with no replications. For each individual attribute, approximately 24–72 data points are generated. A maximum of six codes may be ranked at one time. More codes may be assessed in multiple studies; however, a control code should be present in each study to provide a common reference if codes are to be compared across multiple studies.

EXAMPLES

Examples 1–6

A single-ply, three-layered uncreped throughdried bath tissue sheet was made generally in accordance with the following procedure using eucalyptus pulp fibers for the outer layers and softwood pulp fibers for the inner layer. Prior to pulping, a quaternary ammonium oleylimidazoline softening agent (Prosoft TQ-1003 from Hercules, Inc.) was added at a dosage of 4.1 kg/Mton of active chemical per metric ton of pulp fiber to the eucalyptus furnish. After allowing 20 minutes of mixing time, the furnish was dewatered using a belt press to approximately 32% consistency. The filtrate from the dewatering process was either sewered or used as pulper make-up water for subsequent pulp fiber batches but not sent forward in the stock preparation or tissue making process. The thickened pulp fiber containing the debonder was subsequently redispersed in water and used as the outer layer furnishes in the tissue making process. The softwood pulp fibers were pulped for 30 minutes at 4 percent consistency and diluted to about 3.2 percent consistency after pulping, while the debonded eucalyptus pulp fibers were diluted to about 2 percent consistency. The overall layered tissue sheet weight was split about 30%/about 40%/about 30% among the eucalyptus/refined softwood/eucalyptus pulp fiber layers. The center layer was refined to levels required to achieve target strength values, while the outer layers provided the surface softness and bulk.

A three layer headbox was used to form the wet tissue sheet with the refined northern softwood kraft stock in the two center layers of the head box to produce a single center layer for the three-layered tissue product described. Turbulence-generating inserts recessed about 3 inches (75 millimeters) from the slice and layer dividers extending about 1 inch (25.4 millimeters) beyond the slice were employed. The net slice opening was about 0.9 inch (23 millimeters) and water flows in all four headbox layers were comparable. The consistency of the stock fed to the headbox was about 0.09 weight percent. The resulting three-layered tissue sheet was formed on a twin wire, suction form roll, former with forming fabrics being Lindsay 2164 and Asten 867A fabrics, respectively. The speed of the forming fabrics was 11.9 meters per second. The newly-formed tissue sheet was then dewatered to a consistency of about 20 to about 27 percent using vacuum suction from below the forming fabric before being transferred to the transfer fabric, which was traveling at about 9.1 meters per second (30% rush transfer). The transfer fabric was an Appleton Wire T807-1. A vacuum shoe pulling about 6–15 inches (150–380 millimeters) of mercury vacuum was used to transfer the tissue sheet to the transfer fabric. The tissue sheet was then transferred to a throughdrying fabric (Lindsay Wire T1205-1) h. The throughdrying fabric was traveling at a speed of about 9.1 meters per second. The tissue sheet was carried over a Honeycomb throughdryer operating at a temperature of about 350° F. (175° C.) and dried to final dryness of about 94–98 percent consistency. The resulting uncreped tissue sheet was then wound into a parent roll.

The parent roll was then unwound and the tissue sheet was calendered twice. At the first station the tissue sheet was calendered between a steel roll and a rubber covered roll having a 4 P&J hardness. The calender loading was about 90 pounds per lineal inch (pli). At the second calendering station, the tissue sheet was calendered between a steel roll and a rubber covered roll having a 40 P&J hardness. The calender loading was about 140 pli. The thickness of the rubber covers was about 0.725 inch (1.84 centimeters). The calendered single-ply tissue sheet was then fed into the rubber-rubber nip of the rotogravure coater to apply the polysiloxane composition to both sides of the tissue sheet. The gravure rolls were electronically engraved, chrome over copper rolls supplied by Specialty Systems, Inc., located at Louisville, Ky. The rolls had a line screen of 200 cells per lineal inch and a volume of 6.0 Billion Cubic Microns (BCM) per square inch of roll surface. Typical cell dimensions for this roll were 140 microns in width and 33 microns in depth using a 130 degree engraving stylus. The rubber backing offset applicator rolls were a 75 Shore A durometer cast polyurethane supplied by American Roller Company, located at Union Grove, Wis. The process was set up to a condition having 0.375 inch interference between the gravure rolls and the rubber backing rolls and 0.003 inch clearance between the facing rubber backing rolls. The simultaneous offset/offset gravure printer was run at a speed of 500 feet per minute using gravure roll speed adjustment (differential) to meter the polysiloxane emulsion to obtain the desired addition rate. The gravure roll speed differential used for this example was 250 feet per minute. This process yielded an add-on level of 2.0 weight percent total solids add-on based on the weight of the tissue. The tissue sheet was then converted into bath tissue rolls.

Table 1 shows results for tissue sheet and/or tissue products treated with AF-21, an aminofunctional hydrophobic polysiloxane, EXP-2076, a non-aminofunctional polyether-polysiloxane, Wetsoft CTW (an aminofunctional polyether-polysiloxane) and various blend combinations. All materials were obtained from Kelmar Industries, Duncan, S.C. All materials were applied via gravure to UCTAD bath basesheet at total silicone solids add-on level target of 2%. These results indicate the utility of using an aminofunctional polyether polysiloxane in conjunction with an aminofunctional polydialkylsiloxane to enhance the hydrophilicity of the tissue sheet and/or tissue product. It is also noted that the aminofunctional polyether polysiloxane performs better than the non-amino functional polyether polysiloxane.

TABLE I

| Example | Polysiloxane | Wet-out Time (unaged), seconds |
|---|---|---|
| 1 | AF-21, aminofunctional polydimethylsiloxane | 13.30 |
| 2 | EXP-2076 (polyether derivitized polysiloxane) | 3.53 |
| 3 | Wetsoft CTW (polyether-derivitized aminopolysiloxane) | 5.0 |
| 4 | ½ (AF-21) + ½ (EXP-2076) | 7.1 |
| 5 | ½ (AF-21) + ½ (Wetsoft CTW) | 5.3 |
| 6 | ⅓ (AF-21) + ⅓ (EXP-2076) + ⅓ (Wetsoft CTW) | 4.9 |

Table 2 viscosities for blends of an aminofunctional polydimethylsiloxane fluid, DC-8175 from Dow-Corning, Inc. Midland, Mich. with an aminofunctional polyether polysiloxane fluid, Wetsoft CTW from Wacker Chemie. As shown the viscosity of the blend increases substantially, reaching a maximum at about 35% by weight of the aminofunctional hydrophobic fluid. The viscosity of the blend is over two times higher than the viscosity of the higher viscosity hydrophilic fluid at this point. The ratio of polysiloxanes to give maximum viscosity may vary depending upon the nature of the specific fluids being blended.

TABLE 2

| Weight Percent Hydrophobic Aminofunctional Polydialkyl Siloxane | Weight Percent Hydrophilic Aminofunctional Polyether Polysiloxane | solution viscosity, cps |
|---|---|---|
| 100 | 0 | 248 |
| 90 | 10 | 304 |
| 70 | 30 | 550 |
| 50 | 50 | 1356 |
| 30 | 70 | 10048 |
| 0 | 100 | 5000 |

Examples 7–10

Examples 7–10 were made in general accordance with the following procedure. The untreated single ply formed tissue sheet used in Examples 1–6 was fed through a uniform pulp fiber depositor (UFD—a type of meltblown die) as described in co-pending U.S. application Ser. No. 10/441,143 filed May 19, 2003. The uniform pulp fiber depositor had 17 nozzles per inch and operated at an air pressure of 20 psi. The die applied a fiberized neat polysiloxane composition onto the tissue sheet. The polysiloxanes used in this example included an aminofunctional polyether polysiloxane fluid, Wetsoft CTW, and blends of Wetsoft CTW with a hydrophobic aminofunctional polydimethylpolysiloxane AF-23, and Wetsoft 648, a non-aminofunctional polyetherpolysiloxane all available from Wacker, Inc., Adrian, Mich. For the blend, each component was present in the blend at approximately 33.3% by weight. The fluid was applied by UFD at a rate of 1% and 2% by weight of dried pulp fiber.

Results in Table 3 demonstrate the improvement in wettability of the blends vs. the aminofunctional polyetherpolysiloxane alone. As shown in Table 3, the blend, although containing a hydrophobic polysiloxane has better aging stability than the aminofunctional polyether polysiloxane alone. All wet out times are in seconds. While not wishing to be bound by theory it is believed that the increased viscosity of the blends may reduce the ability of the polysiloxane to spread into the tissue sheet and the ability of the polysiloxane to reorient leading to improved hydrophilic behavior.

The wet out times of the samples are also compared in Table 3 to two commercially available facial tissue products containing polysiloxanes. As shown by the data, the aged wet out times of the blends of the present invention are significantly less than even the unaged wet out times of these commercial tissue products despite having polydialkylsiloxane levels that are comparable.

TABLE 3

| Example | Silicone | Add-on level % on tissue | Initial Wet Out Time (sec) | % polydialkyl siloxane | Aged Wet Out Time after 10 days at 130° F. | Aged Wet Out Time after 20 days at 130° F. |
|---|---|---|---|---|---|---|
| 7 | 100% Amino | 2 | 3.9 | 0.4 | 9.4 | 15.1 |
| 8 | polyether | 1 | 4.0 | 0.2 | 7.4 | 12.4 |
| 9 | Blend | 2 | 4.8 | 0.6 | 4.1 | 4.3 |
| 10 | Invention | 1 | 3.8 | 0.3 | 3.8 | 3.6 |
| 11 | Control - no silicone | n/a | 3.1 | 0.0 | — | — |
| 12 | PUFFS Extra Strength ® Facial | — | 38.3 | 0.5 | — | — |
| 13 | Kleenex Ultra Soft ® Facial | — | 59.3 | 1.0 | — | — |

Examples 14–21

The following Examples demonstrate the superiority of the aminofunctional polyether polysiloxane/aminofunctional polydialkylsiloxane to the known in the art polyether polysiloxane/aminofunctional polydialkylsiloxane blends and to use of surfactants to improve the hydrophobicity. FTS-226 is a 40% silicone solids emulsion containing 50% by weight of a non-aminofunctional polyether polysiloxane and 50% by weight of a hydrophobic aminofunctional polydimethylsiloxane. FTS-226 is manufactured and sold by Crompton, Inc., Greenwich, Conn.

Examples 14 and 15 show the performance of two commercially available polysiloxane treated facial tissue products. Examples 16 and 17 were prepared in general accordance with the procedure used for preparation of Examples 1–6.

For Examples 18–21 the polysiloxane was applied via a patterned spray application to a fully bleached eucalyptus pulp fiber tissue sheet having a basis weight of 150 grams oven-dry pulp per square meter and a density of 5 $cm^2/g$. The corresponding neat polydimethylsiloxane was applied as a spray onto the pulp fiber tissue sheet at a consistency of 85% or greater. Addition rate was controlled by changing the pump speed and the number of outlet spray valves open. The tissue sheet sample was then allowed to age at ambient conditions for 2-weeks. After two weeks the treated, dried and aged tissue sheet samples were tested for total silicone content and % polydimethylsiloxane using the GC-$BF_3$ method outlined above.

For all examples, 60 $g/m^2$ handsheets were prepared from the treated tissue sheets and/or tissue products according to the procedure outlined above. Retention factors were then obtained by analyzing the handsheets for total silicone content and % polydimethylsiloxane using the GC-$BF_3$ method outlined above. Initial and aged water drop test values were then obtained on the handsheets. Aged drop test values were done after aging the samples for 1 hour at 85° C. Results are shown in Table 4 and demonstrate the superiority of using a hydrophilic amino functional polyether polysiloxane/hydrophobic aminofunctional polysiloxane blend for both retention of the polysiloxane and maintenance of hydrophilicity through broke repulping.

TABLE 4

| Ex. # | Description | Polydialkyl siloxane content - Starting product/ extracted prod. | Retention Factor | Initial drop test time in seconds. | Aged drop test time in seconds, extracted product |
|---|---|---|---|---|---|
| 14 Kleenex Ultra Soft ® Facial | — | 1.0/0.94 | 0.94 | 16 sec. | >180 |
| 15 PUFFS ® Extra Strength Facial | — | 0.50/0.41 | 0.82 | 15 sec. | 45 sec. |

TABLE 4-continued

| Ex. # | Description | Polydialkyl siloxane content - Starting product/ extracted prod. | Retention Factor | Initial drop test time in seconds. | Aged drop test time in seconds, extracted product |
|---|---|---|---|---|---|
| 16 1.0% FTS-226 | 50% non-amino functional polyether + 50% amino functional PDMS | 0.80/0.42 | 0.53 | 6 sec. | >180 |
| 17 2.0% Wetsoft CTW | 100% aminofunctional polyether | 0.54/0.46 | 0.85 | 0 sec. | 4 sec. |
| 18 1% DC-8175 | 100% amino PDMS applied discontinuous as neat fluid on surface | 1.0/0.82 | 0.82 | 11 sec. | >180 |
| 19 70% Wetsoft CTW/30% DC-8175 at 1% | Invention | 0.6/0.6 | 1.0 | 2 sec. | 3 sec. |
| 20 50% Wetsoft CTW/50% DC-8175 at 1% | Invention | 0.8/0.8 | 1.0 | 7 sec. | 15 sec. |
| 21 30% Wetsoft CTW/70% DC-8175 | Invention | 0.9/0.9 | 1.0 | 10 sec. | 135 sec. |

Examples 20–22

Examples 20–22 demonstrate the improved softness achieved with the blend of the aminofunctional polysiloxane and aminofunctional polyether polysiloxane. All tissue sheets and/or tissue products in these Examples were prepared in general accordance with the tissue sheets and/or tissue products in Examples 1–6. Addition level was 1.7% silicone solids based on total dry pulp fiber weight.

Example 20 is an aminofunctional polyether polysiloxane, Wetsoft CTW. Example 21 is a blend of an experimental hydrophobic aminofunctional polysiloxane and DC-5324 a non-amino functional polyether polysiloxane available from Dow Corning, Inc., Midland, Mich. Example 23 is a blend of 33% by weight Wetsoft CTW, an amino functional polyether polysiloxane, 34% by weight AF-23, an aminofunctional hydrophobic polysiloxane and 33% by weight Wetsoft 648, a polyalkylene oxide modified polydimethylsiloxane. All silicones were added as a 25% solids emulsion to the tissue sheet and/or tissue product. After converting, samples of the tissue sheets and/or tissue products were analyzed by the sensory panel for softness and stiffness. As shown in Table 5, the blend of aminofunctional polyether polysiloxane shows both superior softness and stiffness attributes relative to the non-aminofunctional polyether blend as well as preference to the aminofunctional polyether polysiloxane alone. Softness and stiffness are ranked such that a ranking of A has the highest softness and lowest stiffness. Statistically meaningful differences are captured by the uniqueness of the ranking. Thus in Table 5, the softness and stiffness preferences of Code 22 over Codes 20 and 21 is statistically significant based on the testing. The softness preference of Code 21 over Code 20 is statistically significant, however, the stiffness of Code 21 is only directionally preferred over Code 20. Note also the high wet out time of Code 21. This wet out time could be adjusted by increasing the amount of non-aminofunctional polyether relative to the hydrophobic aminofunctional polysiloxane. However, such a change would be expected to produce a less soft, stiffer tissue sheet and/or tissue product.

TABLE 5

| Example | Polysiloxane | Softness Rank | Stiffness Rank | GMT | Initial wet out time in seconds |
|---|---|---|---|---|---|
| 20 | 100% Aminofunctional polyether | C | C | 767 | 5.1 sec. |
| 21 | Hydrophobic aminofunctional + non-aminofunctional polyether | B | BC | 850 | 17.3 sec. |
| 22 | Hydrophobic aminofunctional + aminofunctional polyether + non-amino functional polyether | A | A | 752 | 4.1 sec. |

While the embodiments of the present invention described herein are presently preferred, various modifications and improvements may be made without departing from the spirit and scope of the present invention. The scope of the present invention is indicated by the appended claims, and all changes that fall within the meaning and range of equivalents are intended to be embraced therein.

We claim:

1. A polysiloxane treated hydrophilic tissue sheet wherein the polysiloxane comprises:

a) at least one amino-functional hydrophobic polysiloxane having a functional group capable of substantively affixing the polysiloxane to pulp fibers; and b) at least one amino-functional hydrophilic polysiloxane having a functional group capable of substantively affixing the polysiloxane to pulp fibers, said tissue sheet having a polydialkylsiloxane content of about 0.4% or greater by weight of dry pulp fibers and a wet out time after aging 20 days at about 130° F. of about 10 seconds or less.

2. The polysiloxane treated hydrophilic tissue sheet of claim 1, wherein the polydialkylsiloxane content is about 0.6% or greater by weight of dry pulp fibers.

3. The polysiloxane treated hydrophilic tissue sheet of claim 1, wherein the polydialkylsiloxane content is greater than about 0.8% or greater by weight of dry pulp fibers.

4. The polysiloxane treated hydrophilic tissue sheet of claim 1, wherein the wet out time after aging 20 days at about 130° F. is about 8 seconds or less.

5. The polysiloxane treated hydrophilic tissue sheet of claim 1, wherein the wet out time after aging 20 days at about 130° F. is about 5 seconds or less.

6. The polysiloxane treated hydrophilic tissue sheet of claim 1, wherein the polysiloxane is applied uniformly across at least one exterior surface of the tissue sheet.

7. The polysiloxane treated hydrophilic tissue sheet of claim 1, wherein the polydialkylsiloxane is polydimethylsiloxane.

8. The polysiloxane treated hydrophilic tissue sheet of claim 1, wherein the tissue sheet is a single ply tissue product.

9. The polysiloxane treated hydrophilic tissue sheet of claim 1, wherein the tissue sheet is a multi-ply tissue product.

10. The polysiloxane treated hydrophilic tissue sheet of claim 1, wherein the weight ratio of hydrophobic polysiloxane having a functional group capable of substantively affixing the polysiloxane to pulp fibers to hydrophilic polysiloxane having a functional group capable of substantively affixing the polysiloxane to pulp fibers is from about 1:4 to about 4:1.

11. The polysiloxane treated hydrophilic tissue sheet of claim 1, wherein the weight ratio of hydrophobic polysiloxane having a functional group capable of substantively affixing the polysiloxane to pulp fibers to hydrophilic polysiloxane having a functional group capable of substantively affixing the polysiloxane to pulp fibers is from about 1:2 to about 2:1.

12. The polysiloxane treated hydrophilic tissue sheet of claim 1, wherein the hydrophilic polysiloxane has a general structure of:

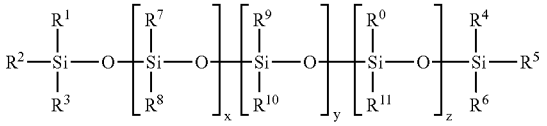

wherein:

x, y and z are integers>0;

the mole ratio of x to (x+y+z) is about 0.95 or less;

the mole ratio of y to (x+y+z) is about 0.25 or less;

each $R^0$–$R^9$ comprises independently an organofunctional group or mixtures thereof;

$R^{10}$ comprises a functional moiety or mixtures thereof capable of substantively affixing the polysiloxane to the pulp fibers; arid, $R^{11}$ comprises a hydrophilic functionality.

13. The polysiloxane treated hydrophilic tissue sheet of claim 12, wherein each $R^0$–$R^9$ moiety comprises independently a $C_1$ or higher alkyl group, aryl group, ether, polyether or polyester group, or mixtures thereof.

14. The polysiloxane treated hydrophilic tissue sheet of claim 12, wherein each $R^7$ and $R^8$ is $CH_3$.

15. The polysiloxane treated hydrophilic tissue sheet of claim 12, wherein $R^{10}$ comprises an amino functional moiety selected from a primary amine, secondary amine, tertiary amine, quaternary amine, unsubstituted amide, and mixtures thereof.

16. The polysiloxane treated hydrophilic tissue sheet of claim 12, wherein $R^{11}$ comprises a polyether functional group having the formula: $—R^{12}—(R^{13}—O)_a—(R^{14}O)_b—R^{15}$ wherein:

each $R^{12}$, $R^{13}$, and $R^{14}$ comprises independently branched $C_{1-4}$ alkyl groups, linear $C_{1-4}$ alkyl groups, or mixtures thereof;

$R^{15}$ comprises H, $C_{1-30}$ alkyl group, or mixtures thereof; and, a and b are integers of from about 1 to about 100.

17. The polysiloxane treated hydrophilic tissue sheet of claim 1, wherein the hydrophobic polysiloxane is a functional polysiloxane having the general structure of:

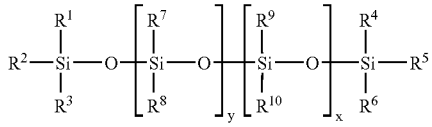

wherein:

x and y are integers=0;

the mole ratio of x to (x+y) is from about 0.001 to about 0.25;

each $R^1$–$R^9$ moiety comprises independently an organofunctional group or mixtures thereof; and, $R^{10}$ comprises a functional moiety capable of substantively affixing the polysiloxane to the pulp fibers.

18. The polysiloxane treated hydrophilic tissue sheet of claim 17, wherein each $R^1$–$R^9$ moiety comprises independently a $C_1$ or higher alkyl group, aryl group, ester, substituted amide, or mixture thereof.

19. The polysiloxane treated hydrophilic tissue sheet of claim 17, wherein the $R^{10}$ moiety comprises an amino functional moiety.

20. The polysiloxane treated hydrophilic tissue sheet of claim 17, wherein the amino functional moiety is selected from the group of primary amine, secondary amine, tertiary amine, quaternary amine, unsubstituted amide, and mixtures thereof.

21. The polysiloxane treated hydrophilic tissue sheet of claim 17, wherein the $R^{10}$ moiety is $—R_{20}—NH—R^{21}—NH_2$ where $R^{20}$ and $R^{21}$ comprise independently a $C_2$ or higher linear or branched alkyl groups.

22. The polysiloxane treated hydrophilic tissue sheet of claim 1, further comprising about 40% or less by weight of at least one additional polysiloxane wherein the at least one additional polysiloxane does not contain a functional group capable of substantively affixing the polysiloxane to the pulp fibers.

23. The polysiloxane treated hydrophilic tissue sheet of claim 22, wherein the at least one polysiloxane has a viscosity of about 200 centipoise or greater at 25° C.

24. The polysiloxane treated hydrophilic tissue sheet of claim 1, wherein the tissue sheet comprises pulp fibers selected from the group consisting essentially of: softwood kraft pulp fibers; hardwood kraft pulp fibers; synthetic fibers; or, mixture thereof.

25. The polysiloxane treated hydrophilic tissue sheet of claim 1, wherein the tissue sheet further comprises a skin health benefit agent.

26. The polysiloxane treated hydrophilic tissue sheet of claim 25, wherein the skin health benefit agent comprises in whole or part, aloe vera extract, a mineral oil, a petrolatum, a wax, a tocopherol or any combination thereof.

27. The polysiloxane treated hydrophilic tissue sheet of claim 1, further comprising a specialty additive selected from the group consisting essentially of: odor control agents; activated carbon fibers or particles; baby powder; baking soda; chelating agents; zeolites; perfumes or fragrances; cyclodextrin compounds; superabsorbent particles; synthetic fibers; cationic dyes; optical brighteners; humectants; and, mixtures thereof.

28. The tissue sheet of claim 1, wherein the tissue sheet has a silicone retention factor of about 0.6 or greater and a water drop test value after aging at about 85° C. for one hour at about 40 seconds or less.

29. The tissue sheet of claim 1, wherein the tissue sheet has a water drop test value after aging at about 85° C. for one hour of about 30 seconds or less.

30. The tissue sheet of claim 1, wherein the tissue sheet has a water drop test value after aging at about 85° C. for one hour of about 15 seconds or less.

31. The tissue sheet of claim 1, wherein the tissue sheet has a water drop test value after aging at about 85° C. for one hour of about 10 seconds or less.

* * * * *